US009900705B2

(12) United States Patent
Cassidy et al.

(10) Patent No.: US 9,900,705 B2
(45) Date of Patent: Feb. 20, 2018

(54) TONE GENERATION

(71) Applicant: Federal Signal Corporation, Oak Brook, IL (US)

(72) Inventors: Scott Cassidy, Crown Point, IN (US); Lonnie Moravetz, Lincoln, NE (US); David L. Corey, Crown Point, IN (US); Robert Steiert, Crete, IL (US)

(73) Assignee: Federal Signal Corporation, Oak Brook, IL (US)

( * ) Notice: Subject to any disclaimer, the term of this patent is extended or adjusted under 35 U.S.C. 154(b) by 547 days.

(21) Appl. No.: 14/162,296

(22) Filed: Jan. 23, 2014

(65) Prior Publication Data

US 2015/0208173 A1 Jul. 23, 2015

(51) Int. Cl.

| | |
|---|---|
| ***H04R 17/00*** | (2006.01) |
| ***G08B 3/10*** | (2006.01) |
| ***G10K 9/12*** | (2006.01) |
| ***G10K 15/02*** | (2006.01) |

(52) U.S. Cl.

CPC ..... *H04R 17/00* (2013.01); *G08B 3/10* (2013.01); *G10K 9/12* (2013.01); *G10K 15/02* (2013.01); *H04R 2430/00* (2013.01)

(58) Field of Classification Search

CPC ..... H04R 17/00; H04R 2430/00; G08B 3/10; G10K 9/12; G10K 15/02

USPC ..... 381/184, 186, 61

See application file for complete search history.

(56) References Cited

U.S. PATENT DOCUMENTS

| | | | | |
|---|---|---|---|---|
| 3,809,791 | A * | 5/1974 | Uchiyama | G10H 1/14 84/675 |
| 4,078,160 | A * | 3/1978 | Bost | B06B 1/0603 310/331 |
| 4,401,857 | A | 8/1983 | Morikawa | |
| 4,724,424 | A | 2/1988 | Nakashima et al. | |
| 4,736,432 | A * | 4/1988 | Cantrell | H04B 1/0475 381/83 |
| 5,237,542 | A | 8/1993 | Burke et al. | |
| 5,484,969 | A | 1/1996 | McKendree et al. | |

(Continued)

FOREIGN PATENT DOCUMENTS

| | | |
|---|---|---|
| EP | 0 025 537 A1 | 3/1981 |
| EP | 1 014 336 A2 | 6/2000 |

(Continued)

OTHER PUBLICATIONS

Abdullah, T. Yahara, "Subtractive Synthesis", Jan. 4, 2012, archive.org, http://web.archive.org/web/20120104093500/http://www.angelfire.com/in2/yala/2ansynth.htm.*

(Continued)

*Primary Examiner* — Davetta W Goins
*Assistant Examiner* — Daniel Seller
(74) *Attorney, Agent, or Firm* — Merchant & Gould P.C.

(57) ABSTRACT

A tone generation system includes a square wave signal generator configured to generate a first series of square wave signals to replicate a fundamental frequency of a desired mechanical tone, and a second series of square waves signals to replicate a second harmonic of the desired mechanical tone. An amplifier is configured to receive the first and second series of square waves, and a speaker is connected to receive an output signal from the amplifier.

4 Claims, 51 Drawing Sheets

(56) References Cited

U.S. PATENT DOCUMENTS

| | | | | |
|---|---|---|---|---|
| 5,754,095 | A * | 5/1998 | Bader | B06B 1/0276 340/384.7 |
| 6,211,774 | B1 | 4/2001 | Steiner | |
| 6,400,821 | B1 | 6/2002 | Burgan et al. | |
| 6,456,113 | B2 | 9/2002 | Kanba | |
| 6,646,548 | B2 | 11/2003 | Dornfeld | |
| 6,788,188 | B2 | 9/2004 | Sague | |
| 6,816,065 | B2 | 11/2004 | Viero | |
| 7,866,438 | B2 | 1/2011 | Stewart, Jr. et al. | |
| 2003/0228020 | A1 | 12/2003 | Lentinturier et al. | |
| 2009/0153221 | A1 | 6/2009 | Aeby | |
| 2010/0166217 | A1 | 7/2010 | Wan | |
| 2012/0002819 | A1 | 1/2012 | Thormundsson et al. | |
| 2012/0182136 | A1 | 7/2012 | Nakayama et al. | |

FOREIGN PATENT DOCUMENTS

| | | | |
|---|---|---|---|
| FR | 2 333 314 | A1 | 6/1977 |
| WO | 03/099468 | A1 | 12/2003 |

OTHER PUBLICATIONS

Partial International Search Report for Application No. PCT/US2015/012259 dated May 8, 2015.

* cited by examiner

FIG. 11
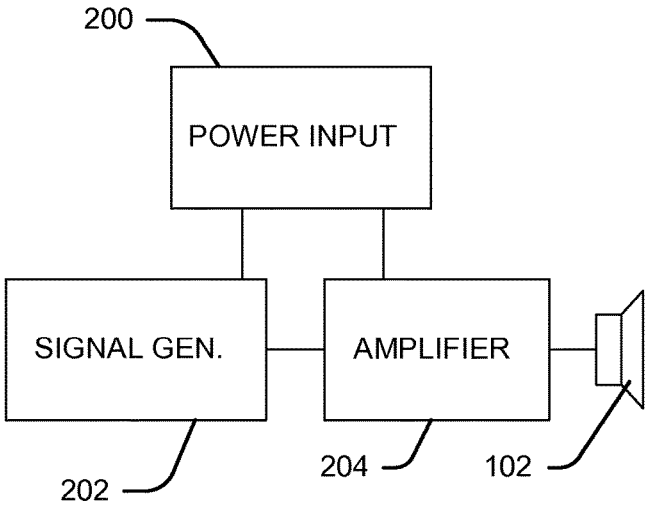
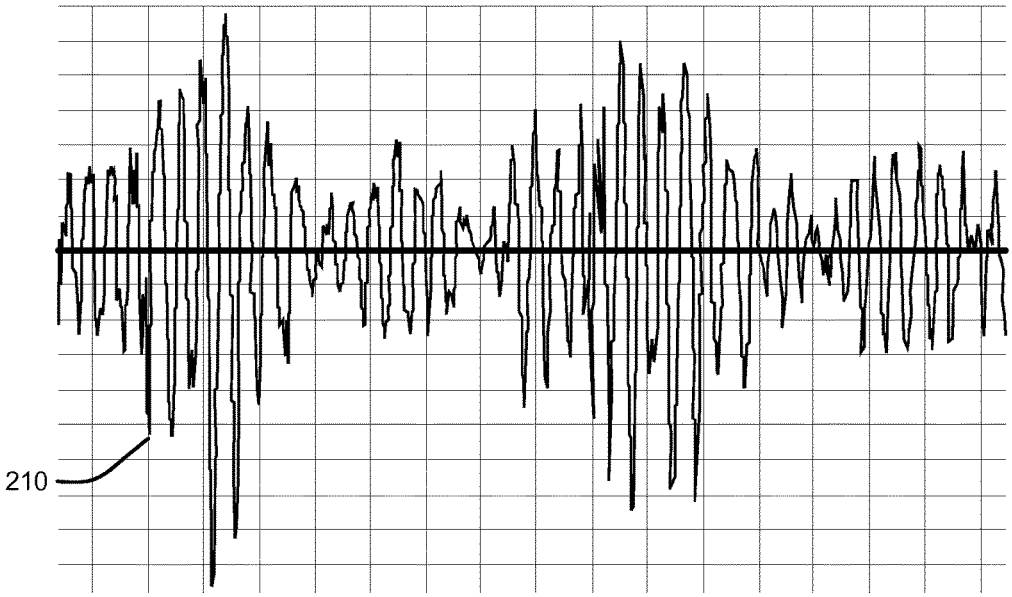
FIG. 12

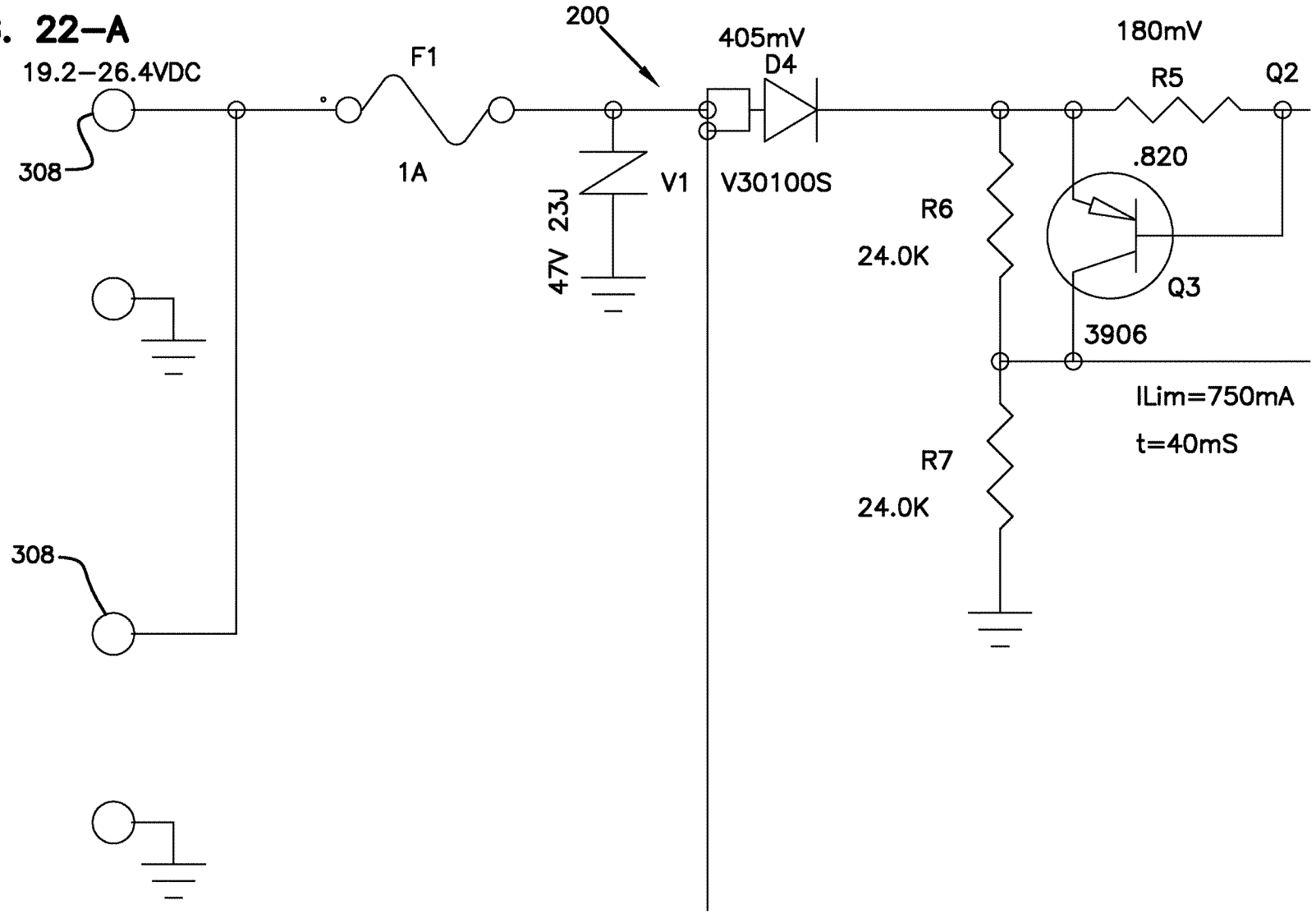
FIG. 22–A

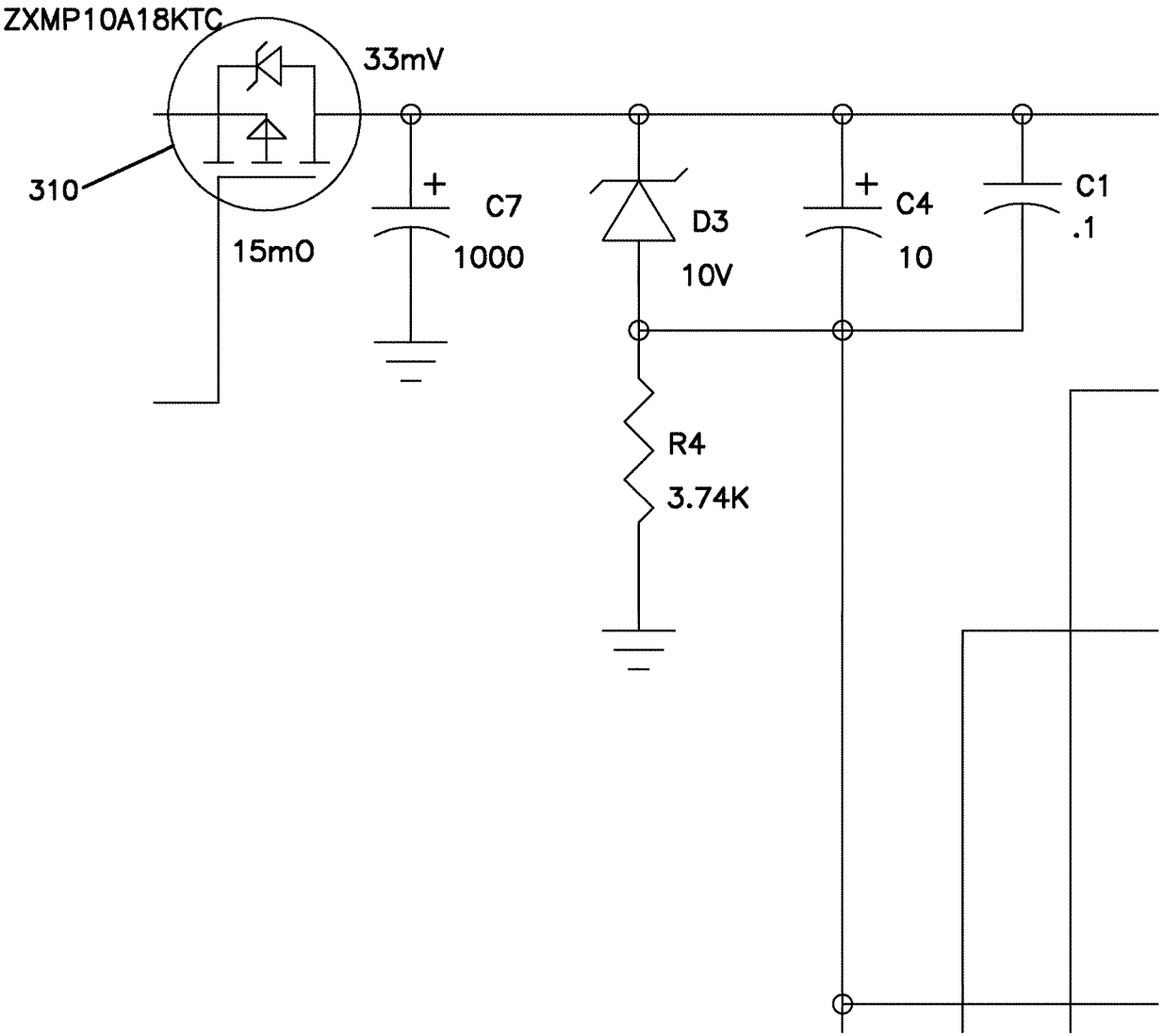
FIG. 22–B

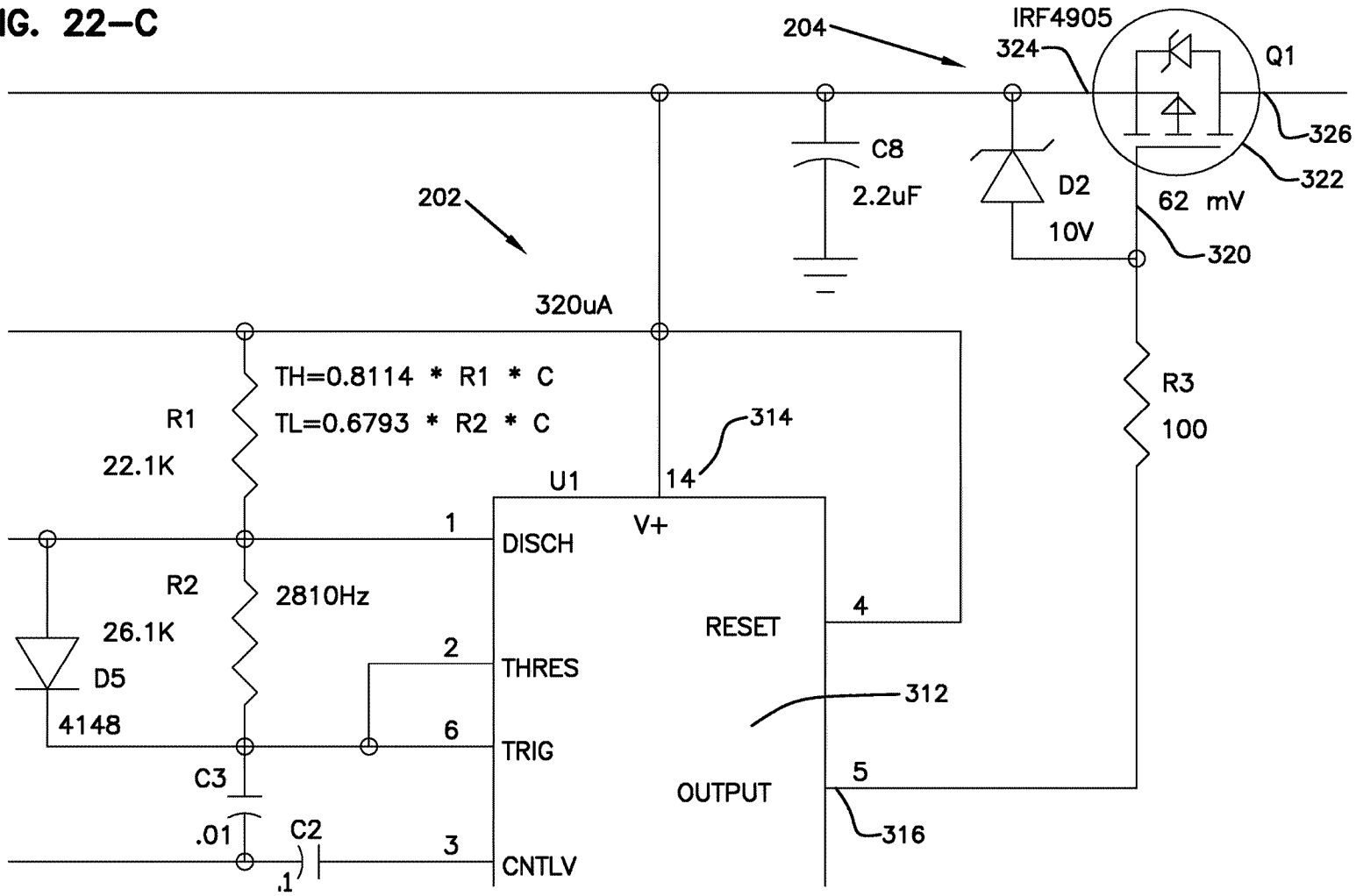
FIG. 22–C

FIG. 22–D
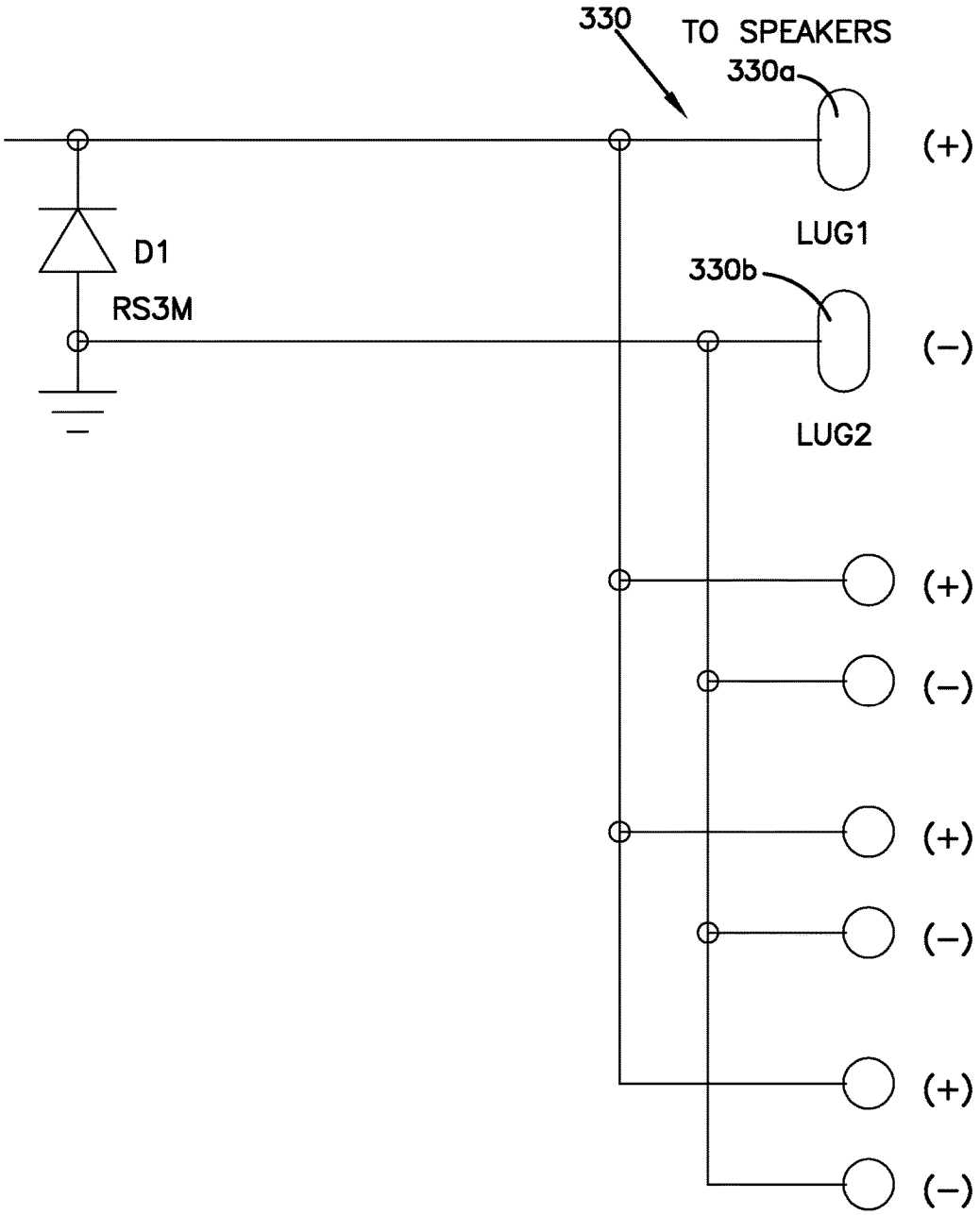

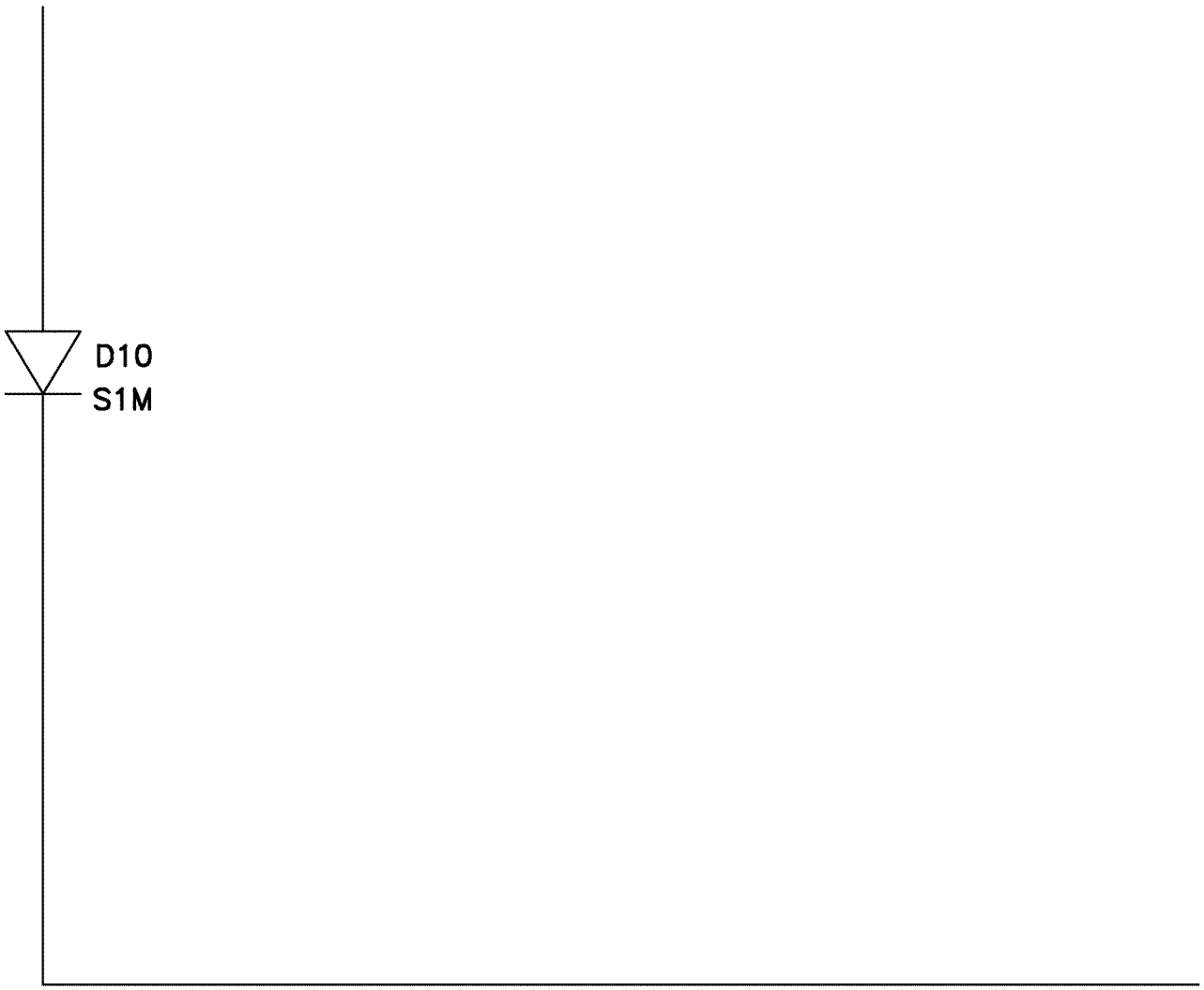
FIG. 22–E

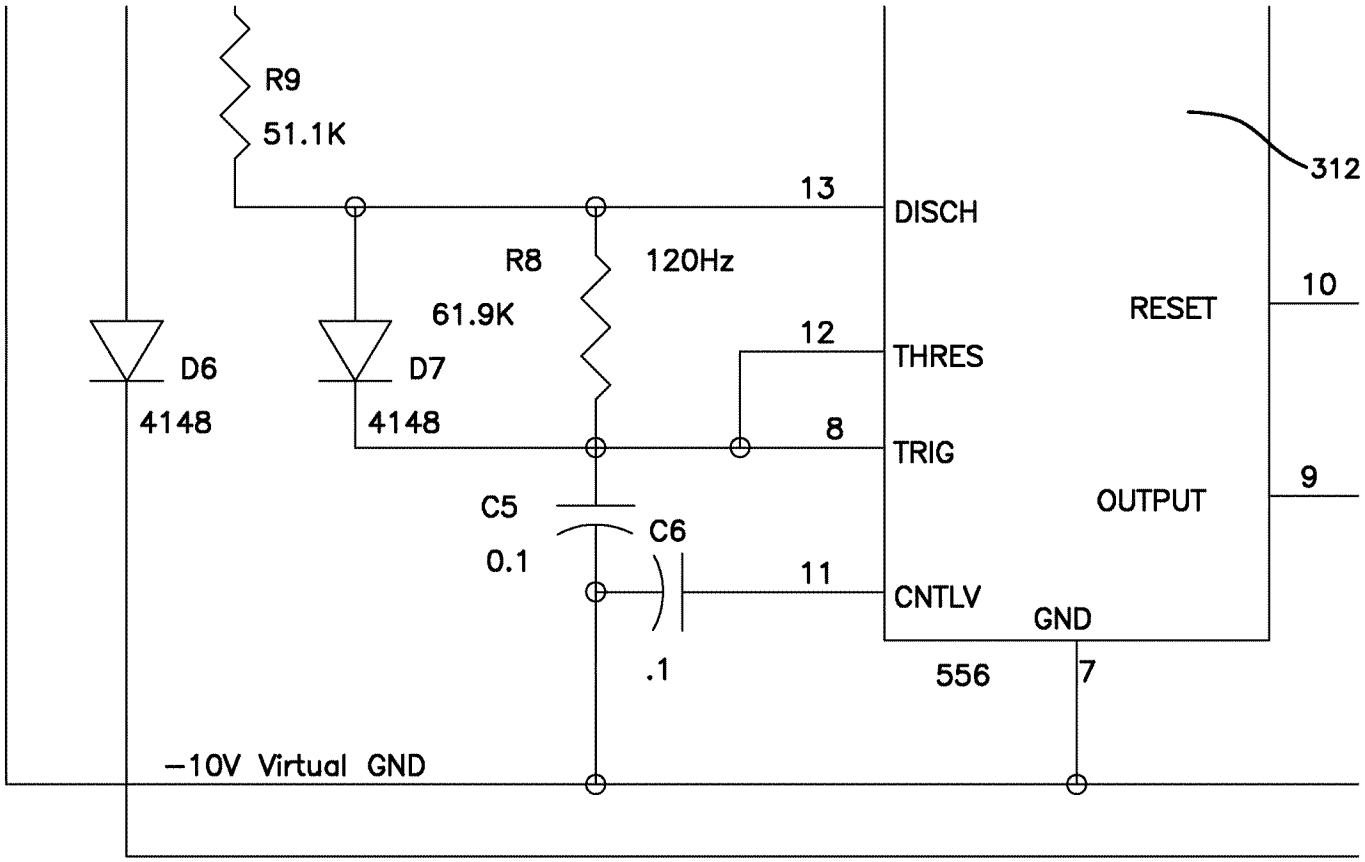
FIG. 22−F

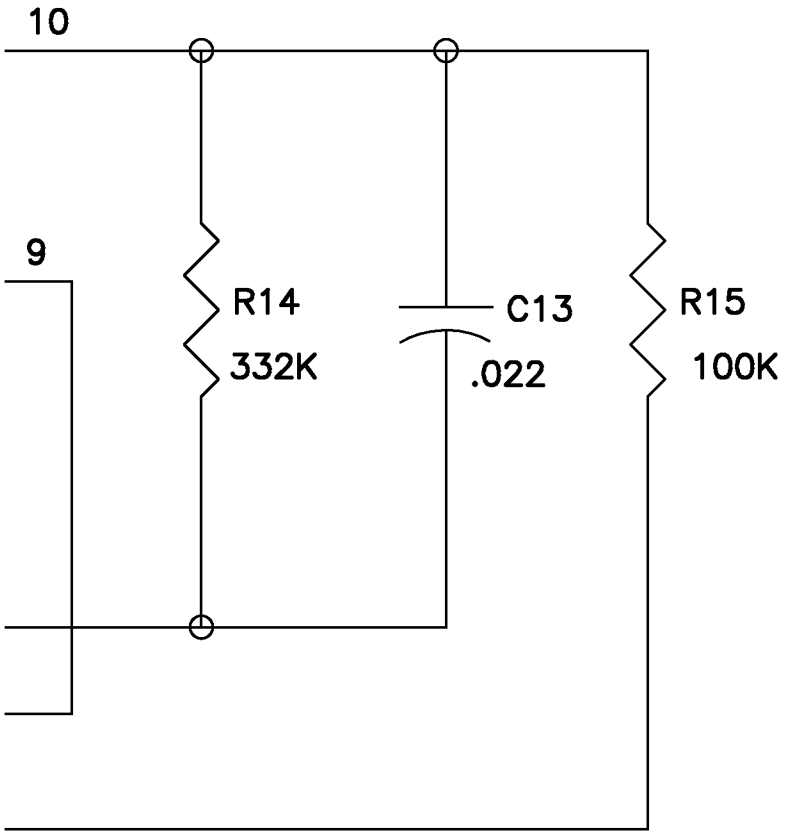
FIG. 22–G

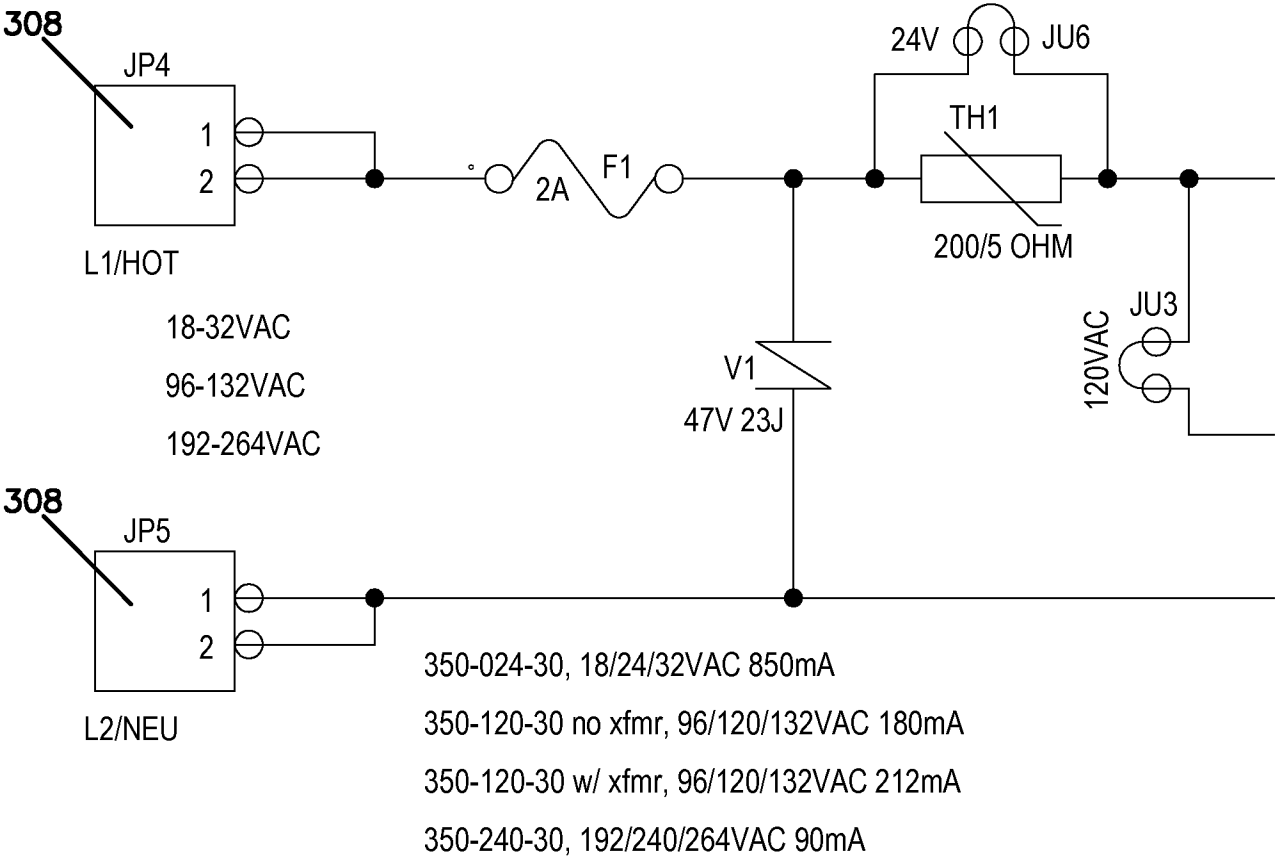
FIG. 23-A

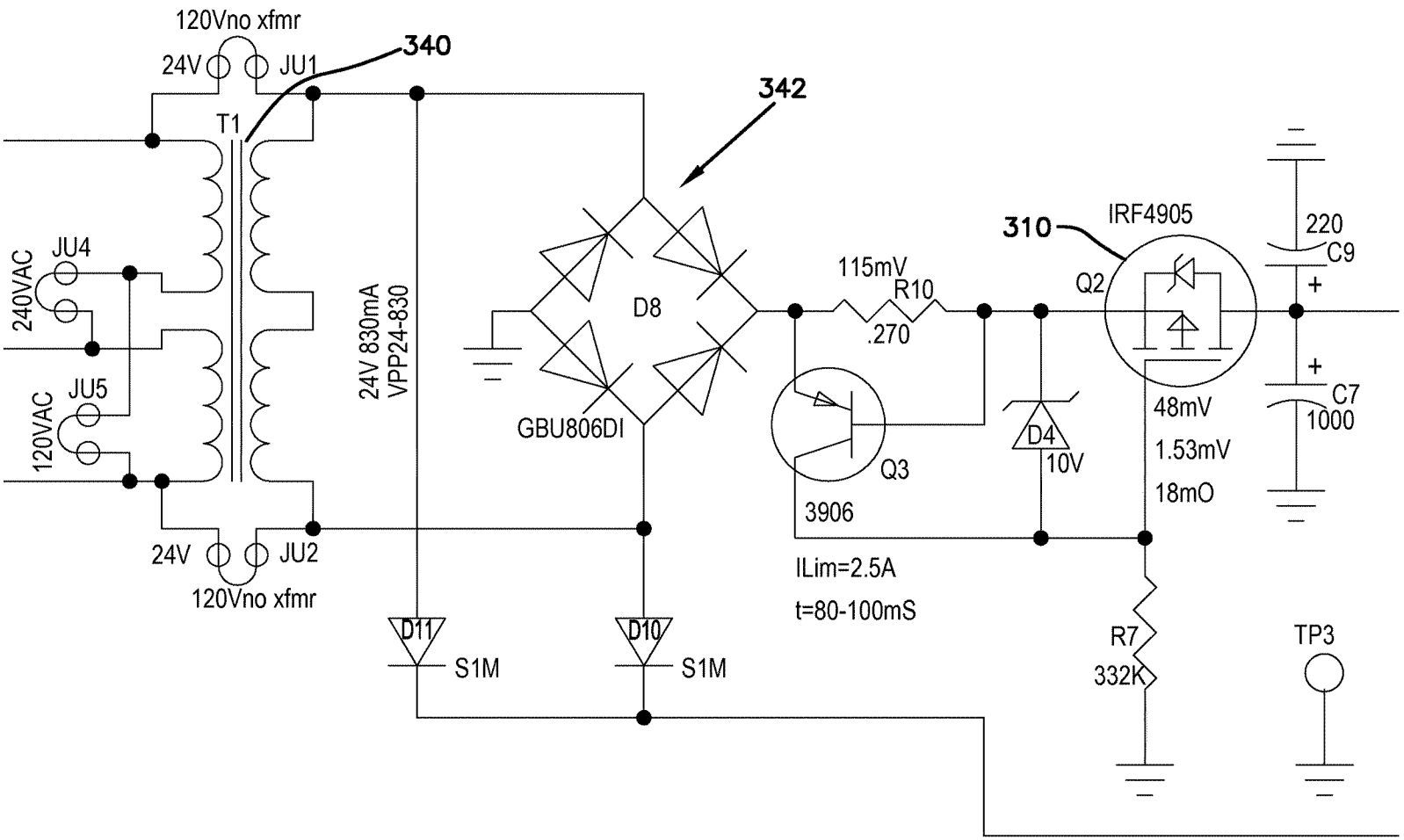
FIG. 23-B

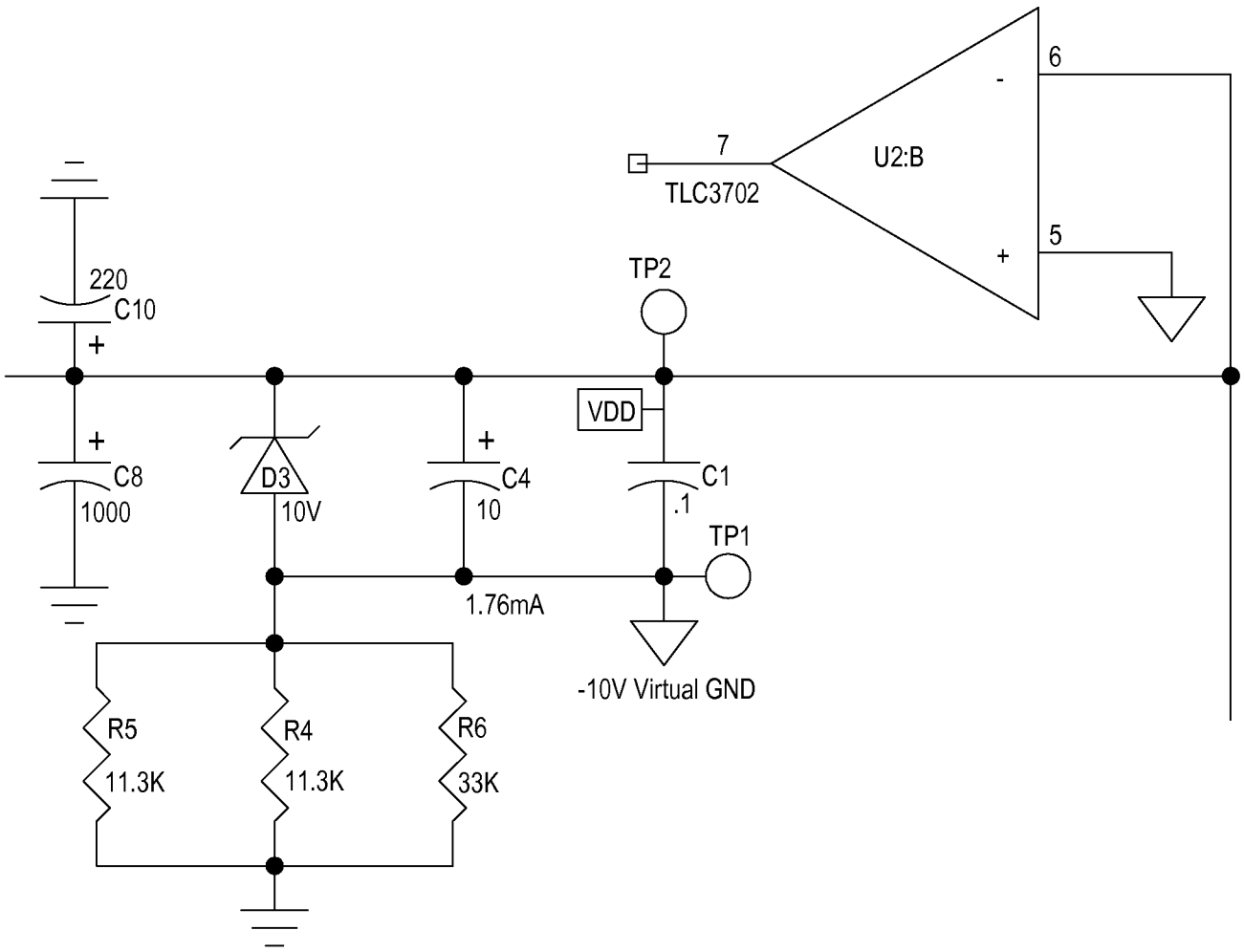
FIG. 23-C

FIG.23-D
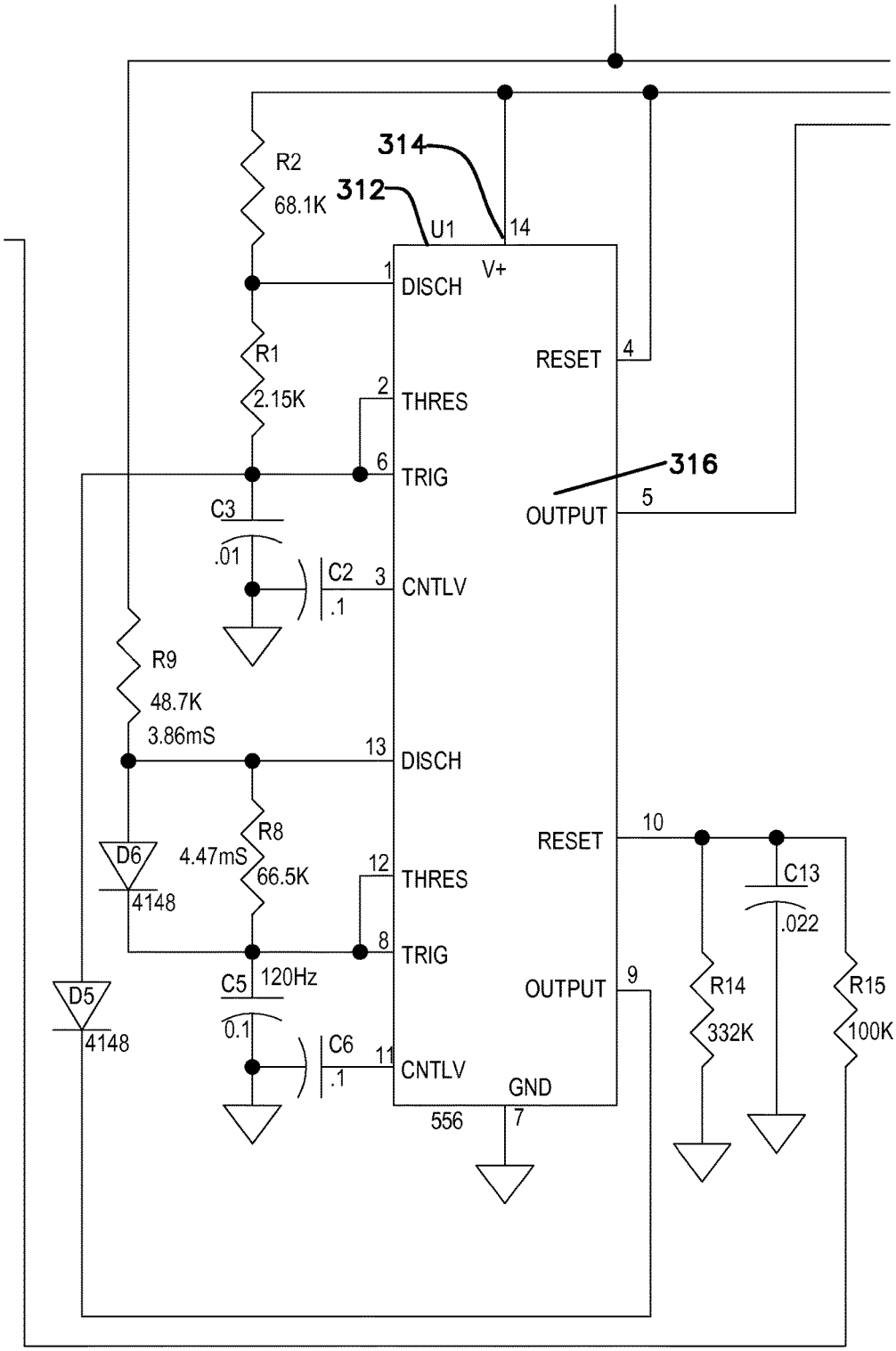

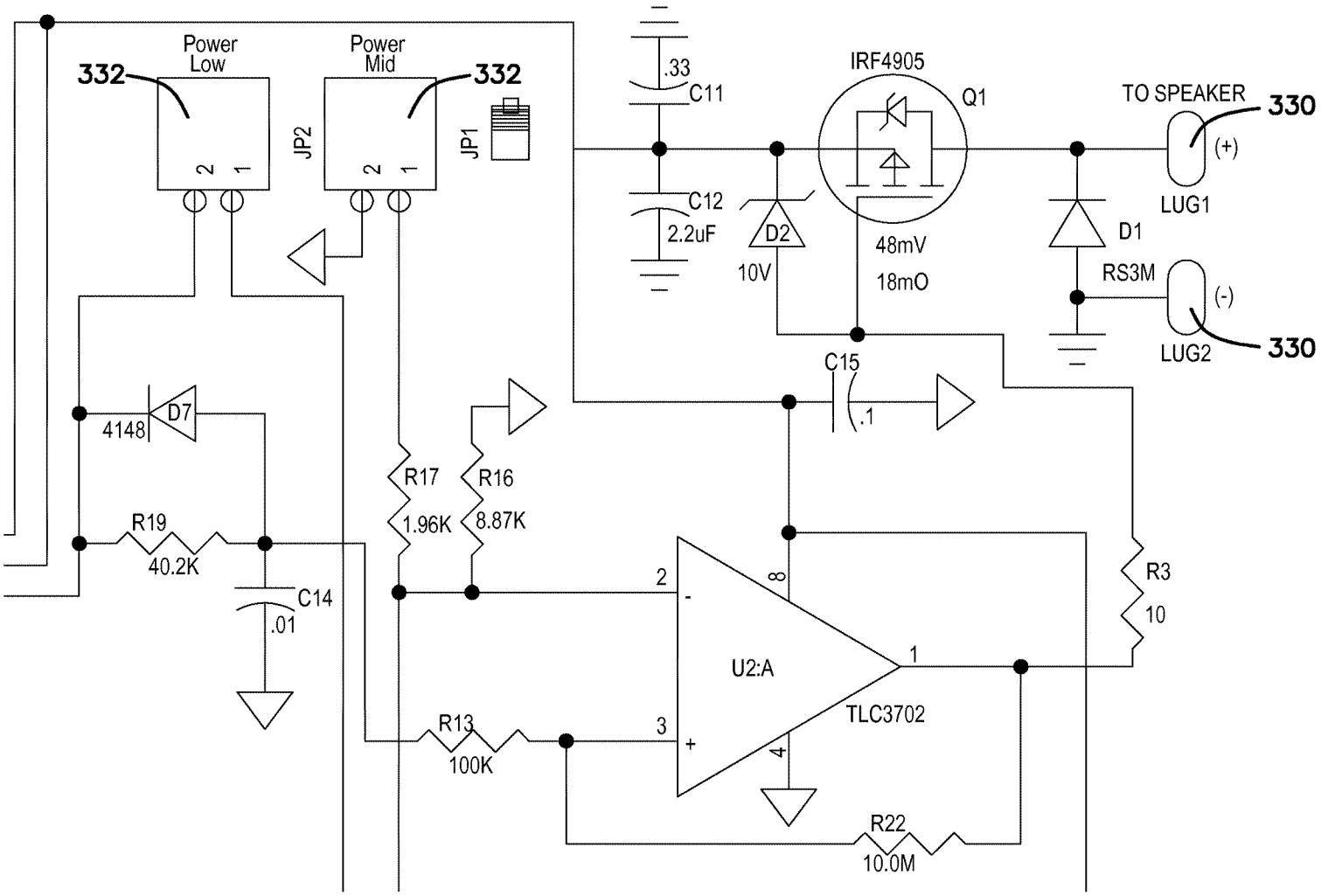
FIG. 23-E

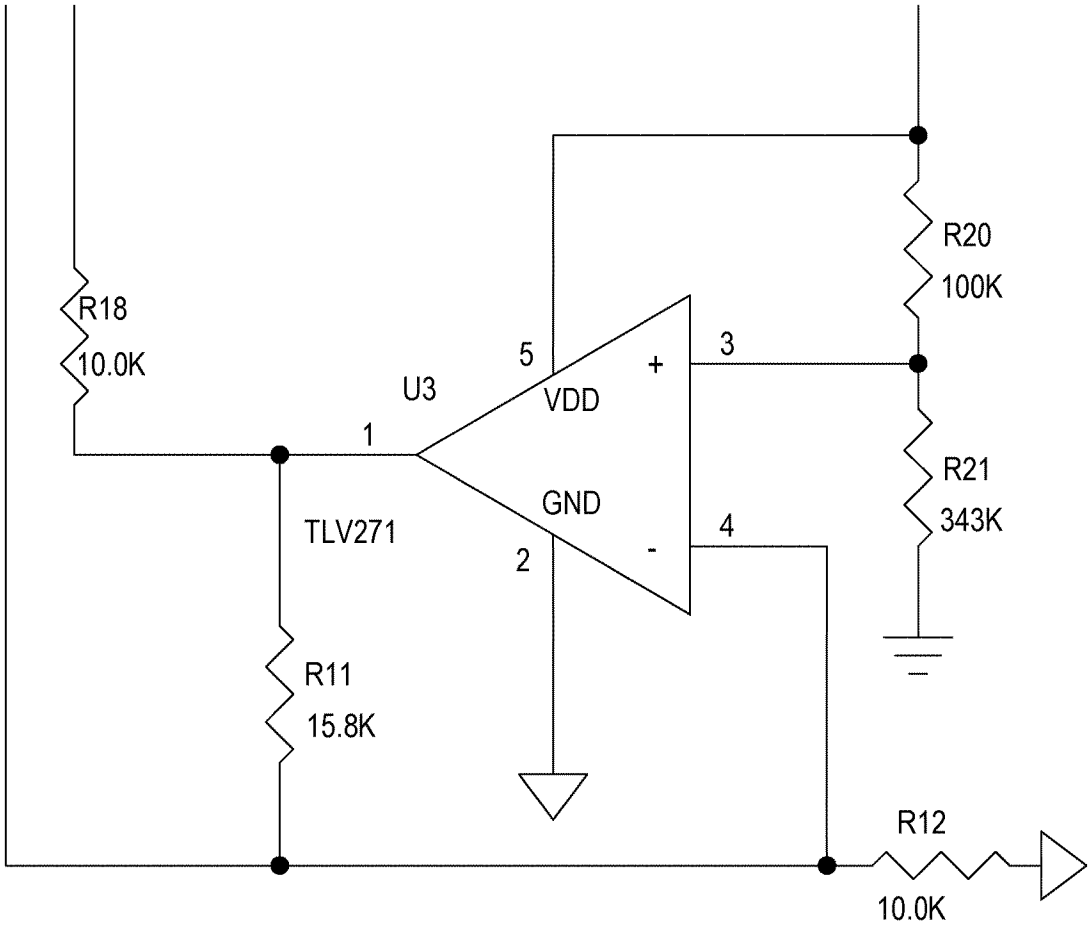
FIG. 23-F

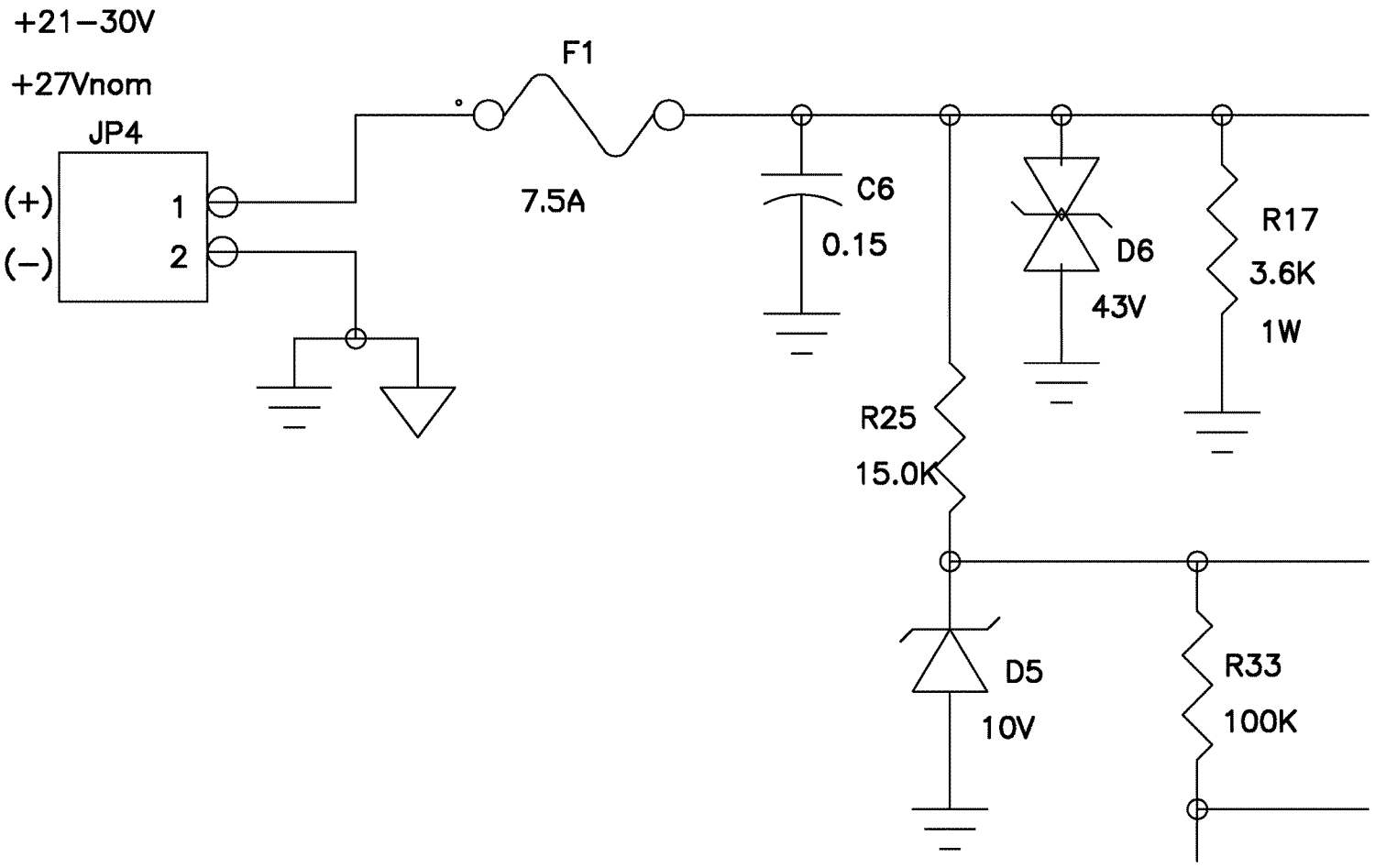
FIG. 24–A

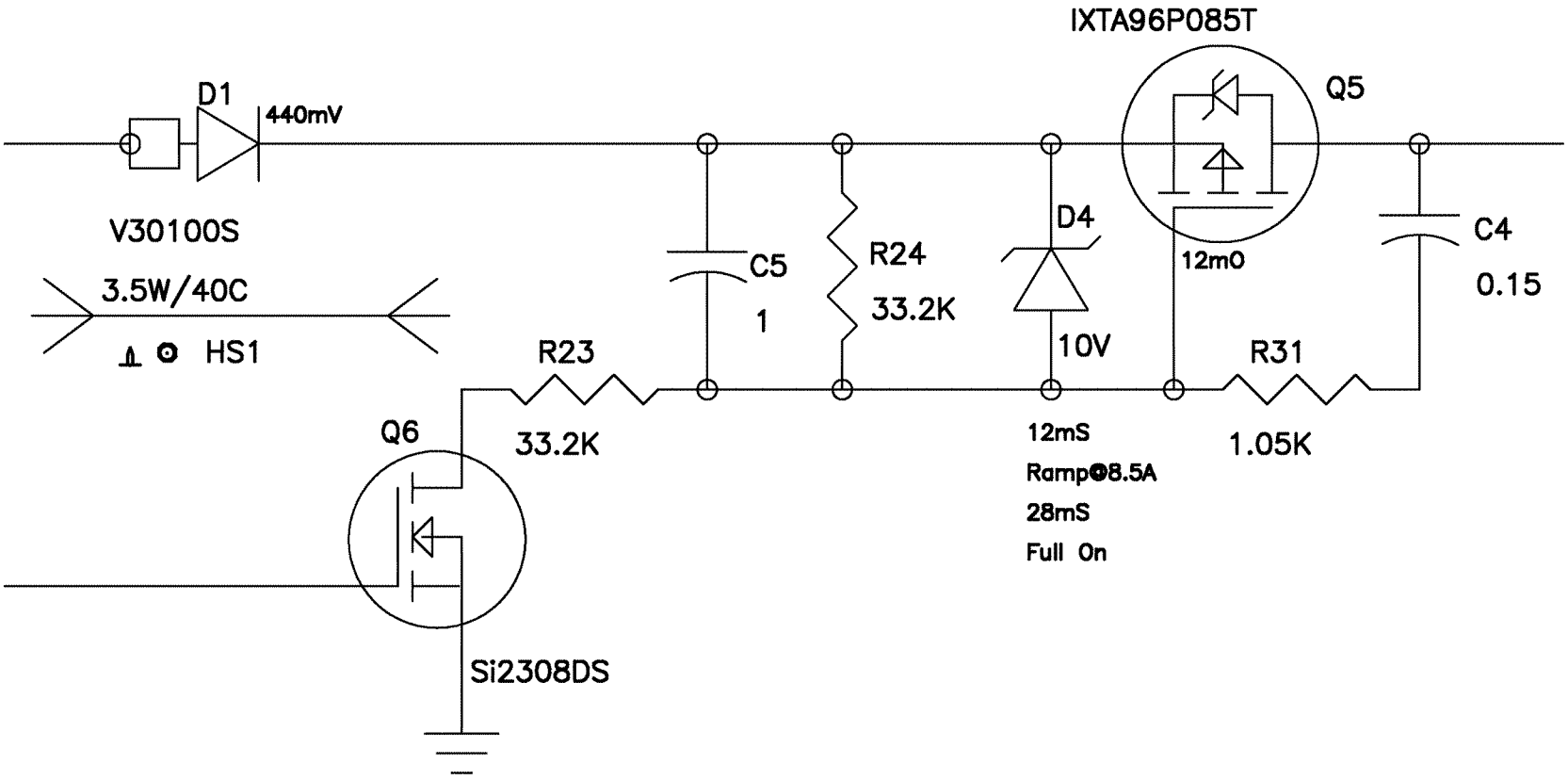
FIG. 24–B

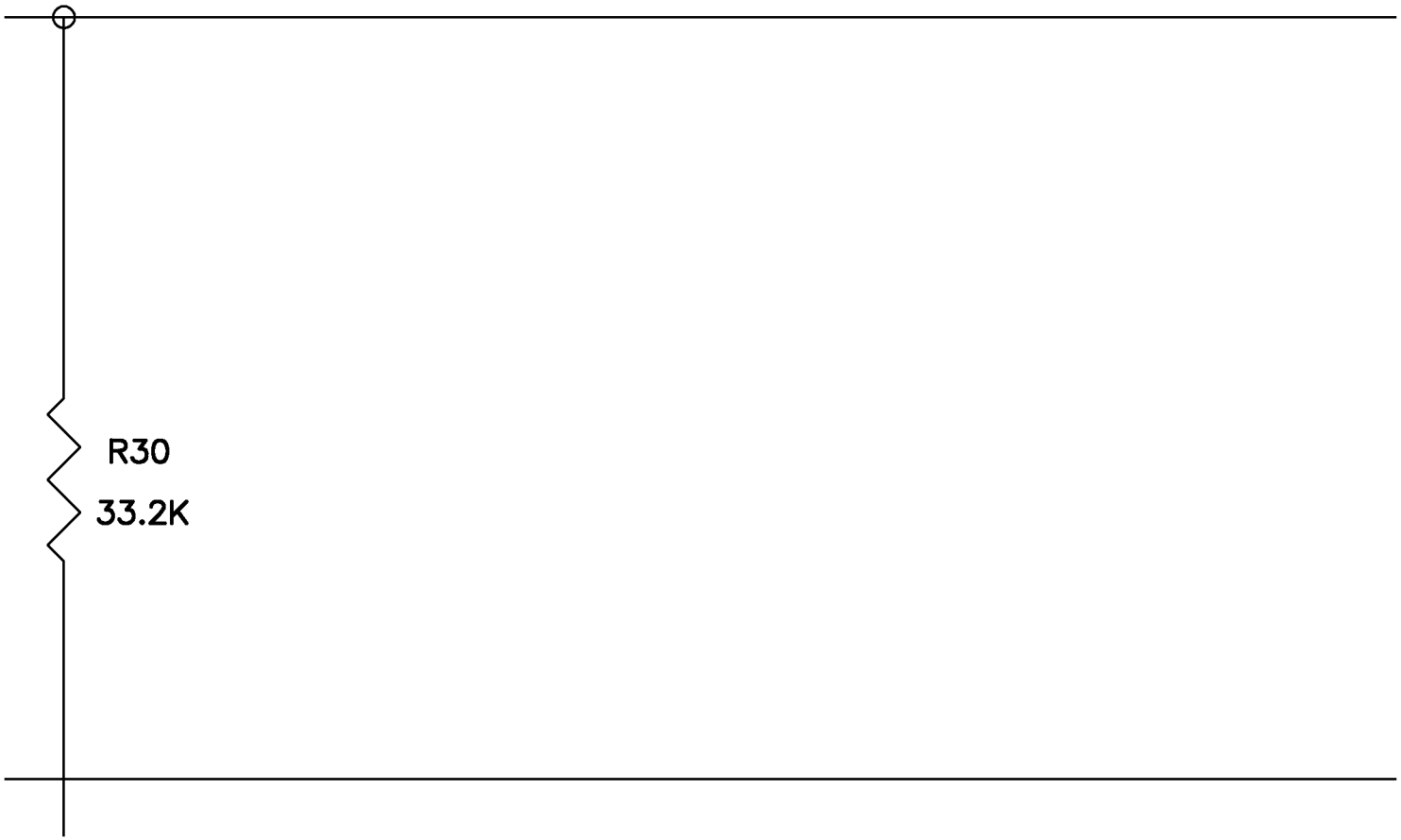
FIG. 24–C

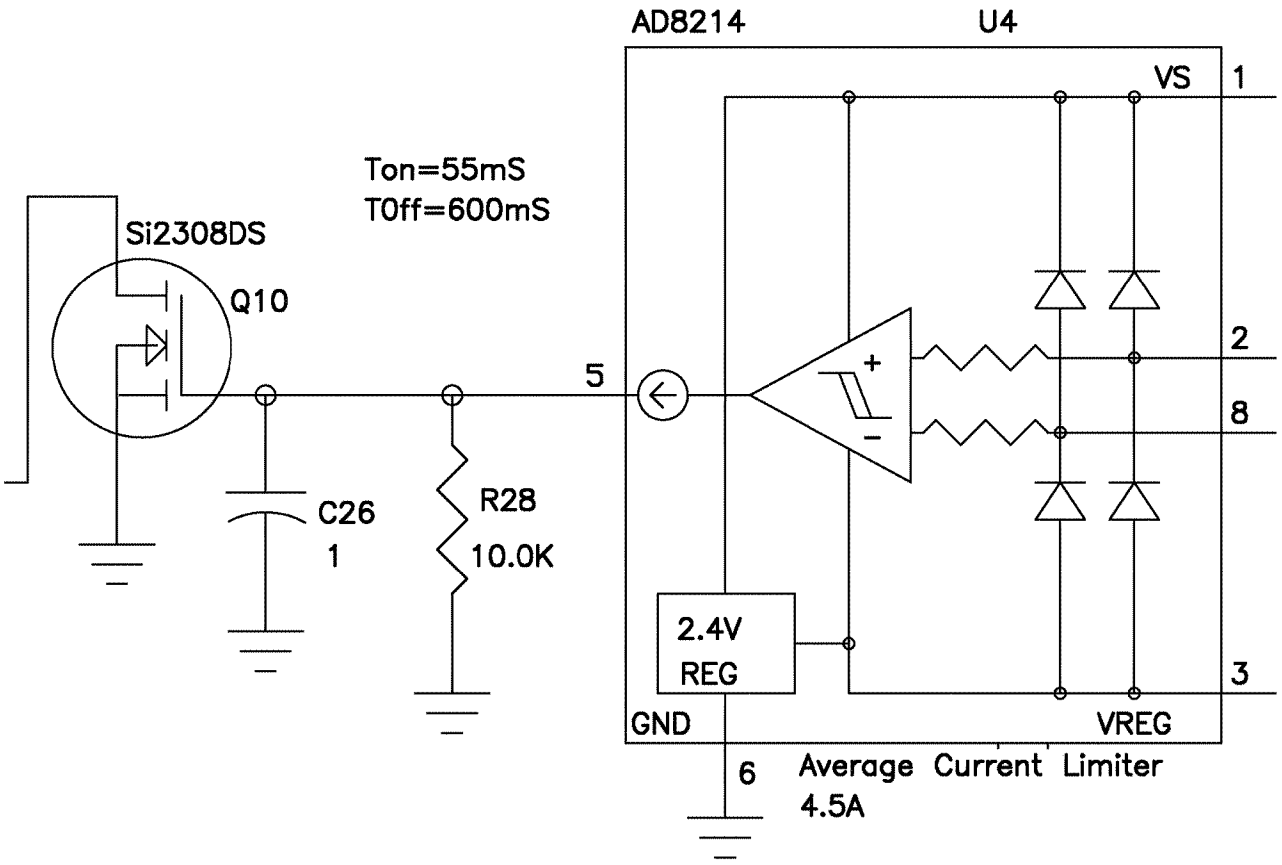
FIG. 24–D

FIG. 24–E
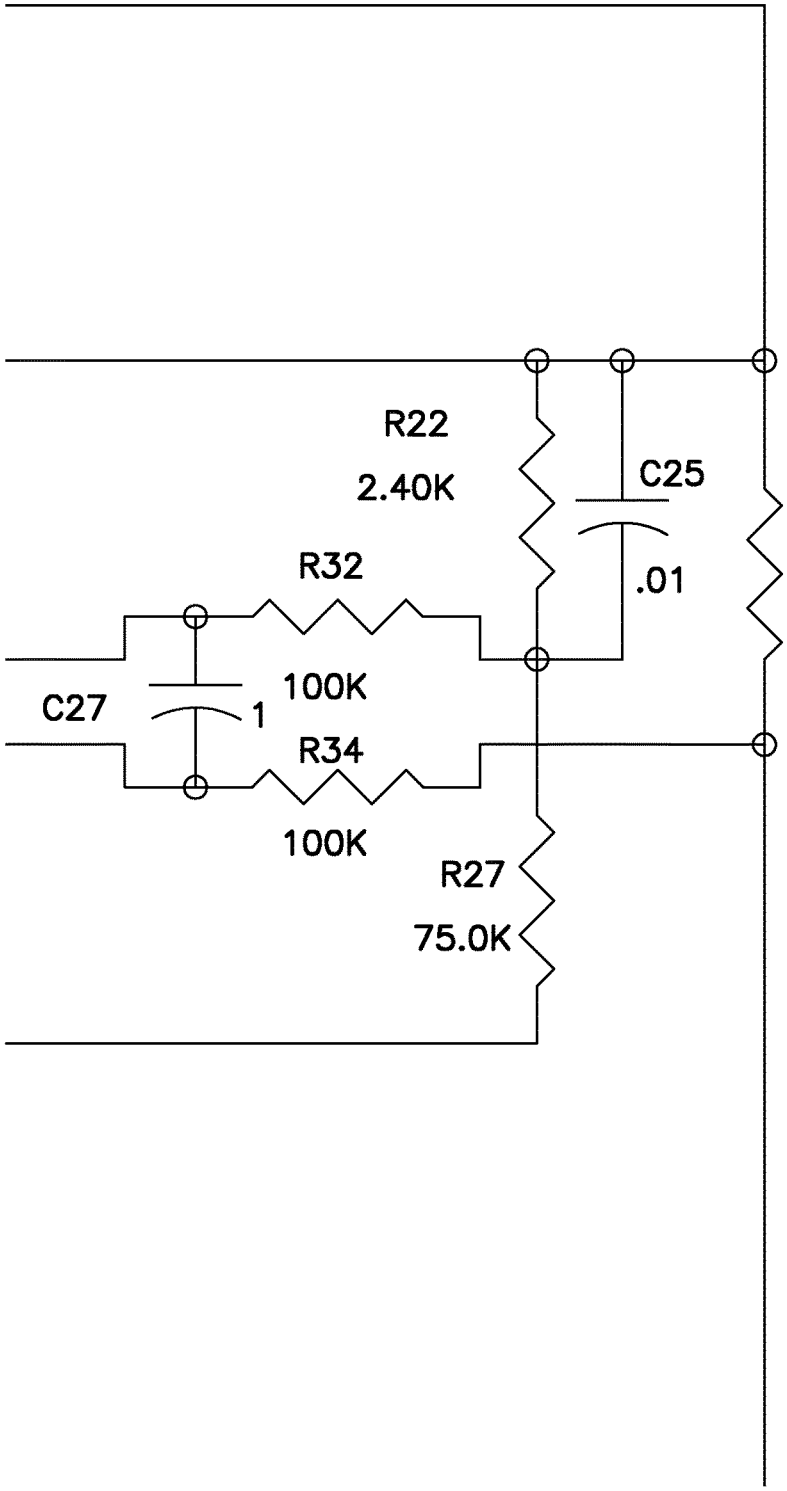

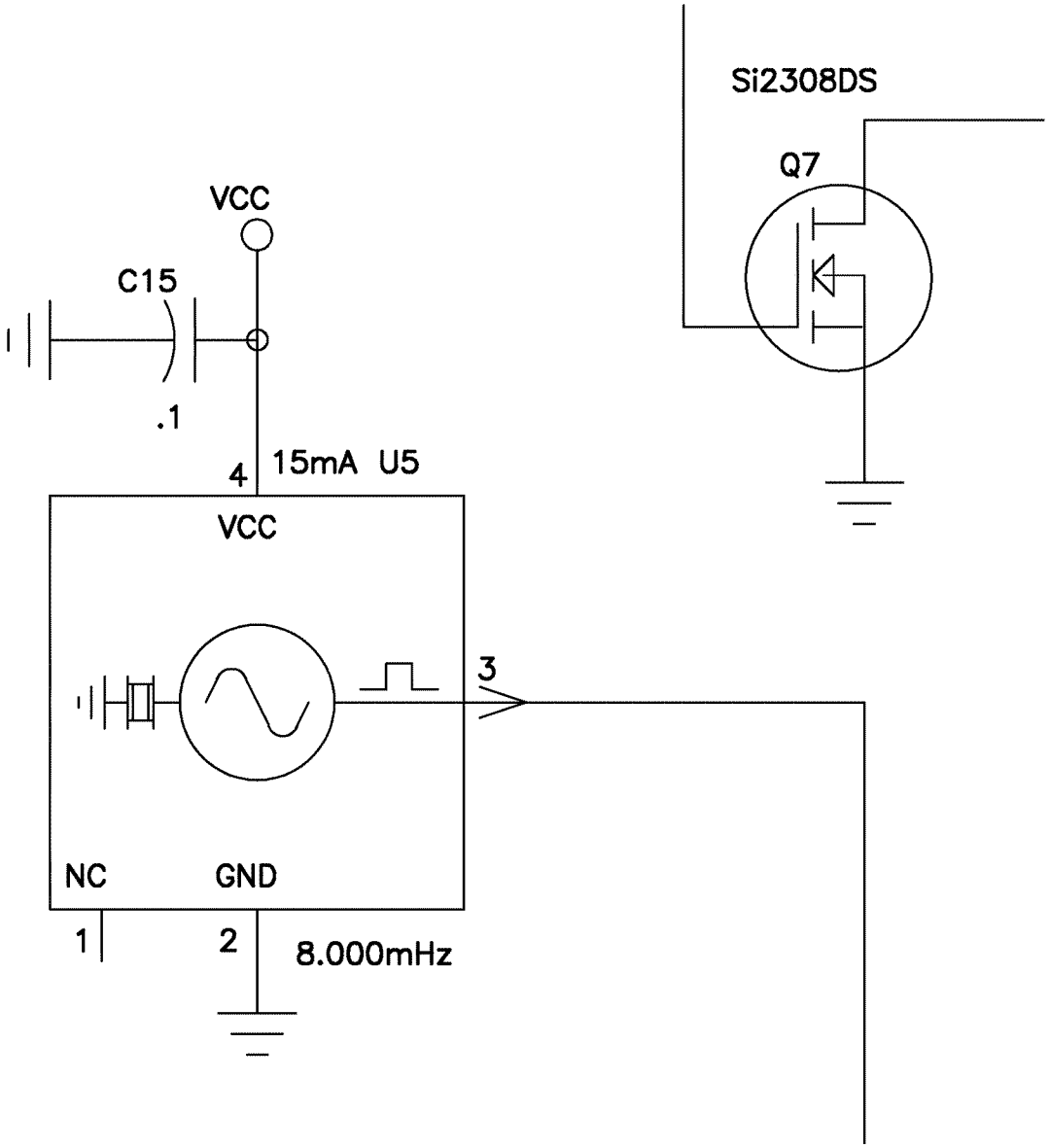
FIG. 24–F

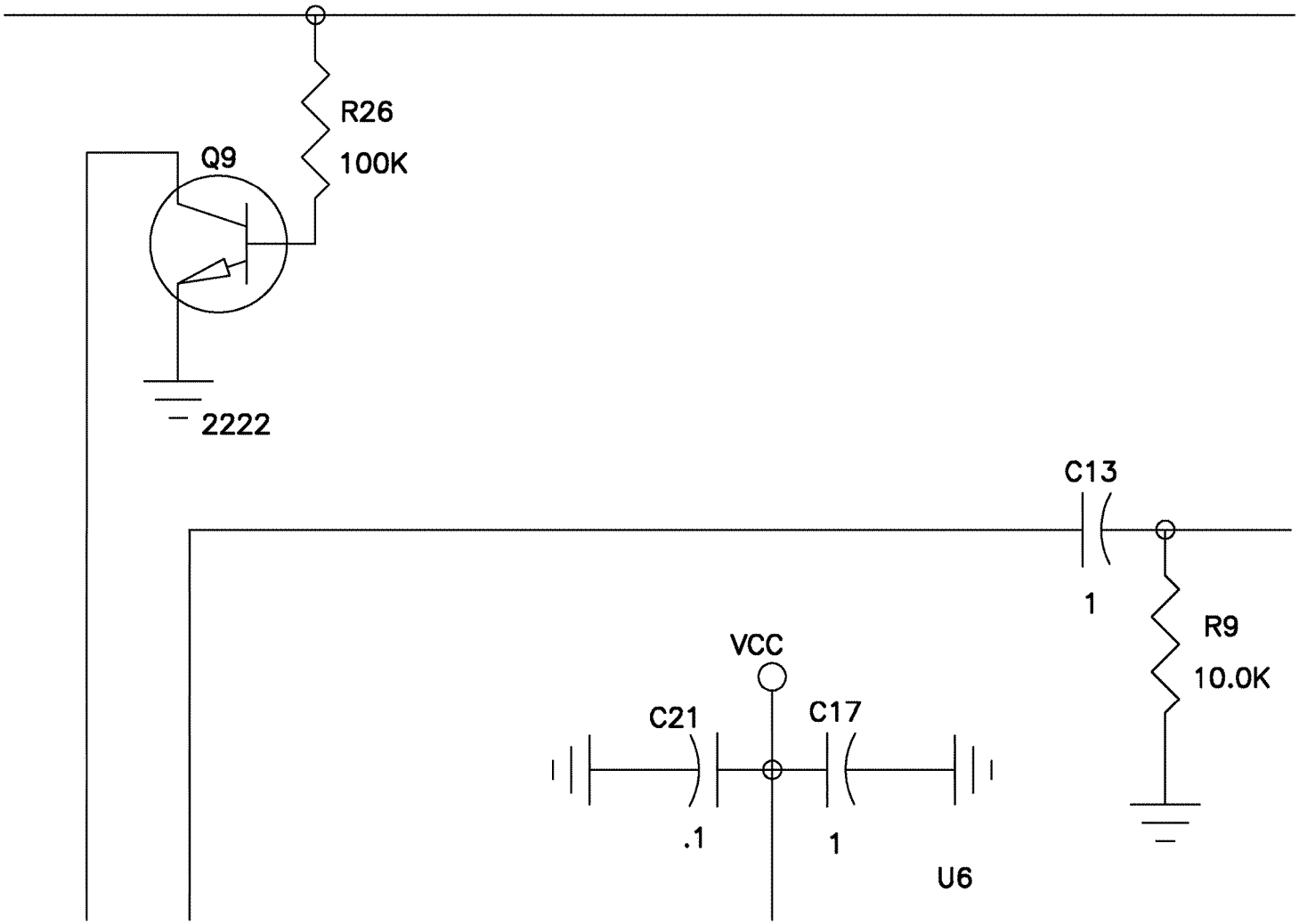
FIG. 24–G

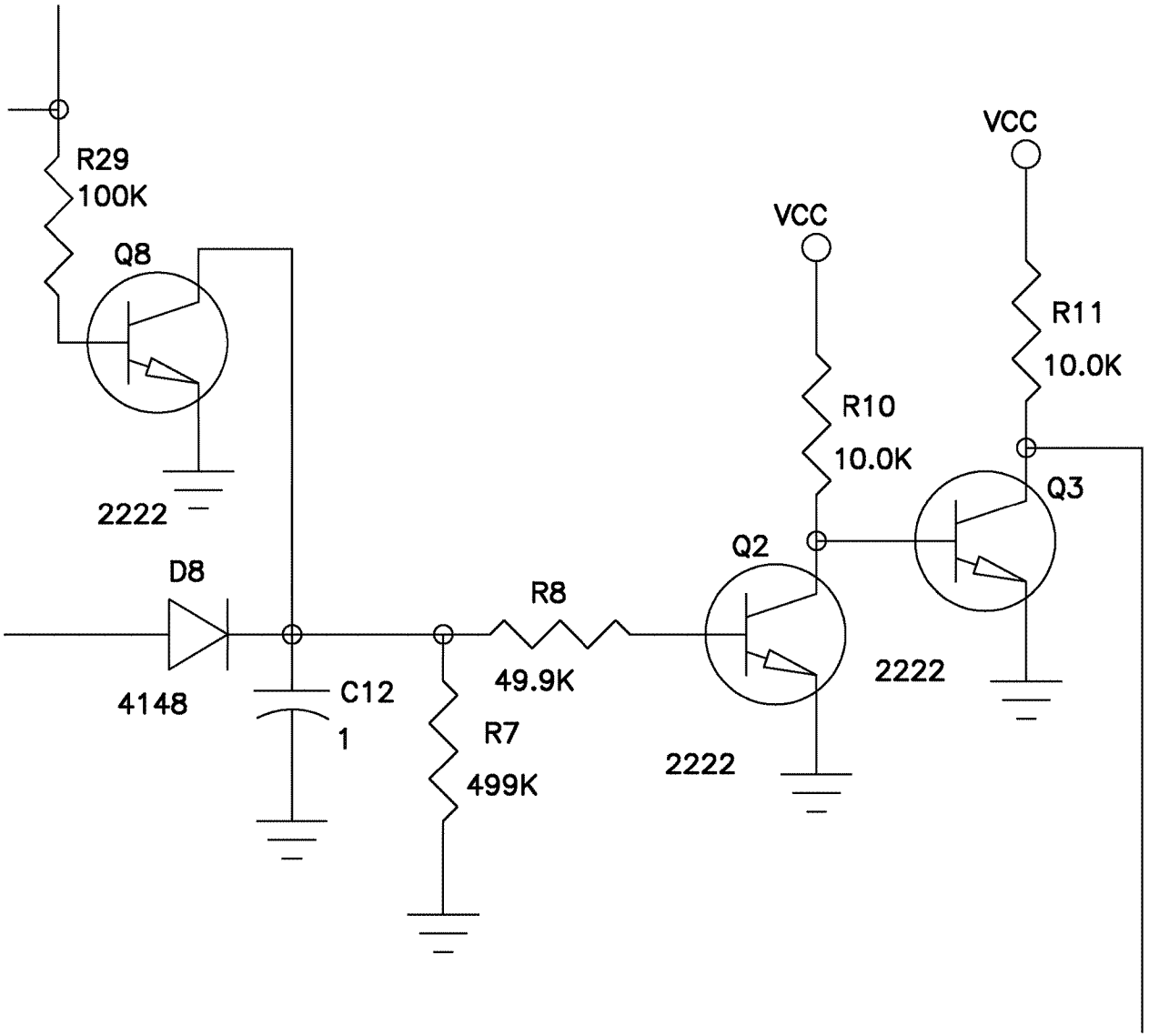
FIG. 24–H

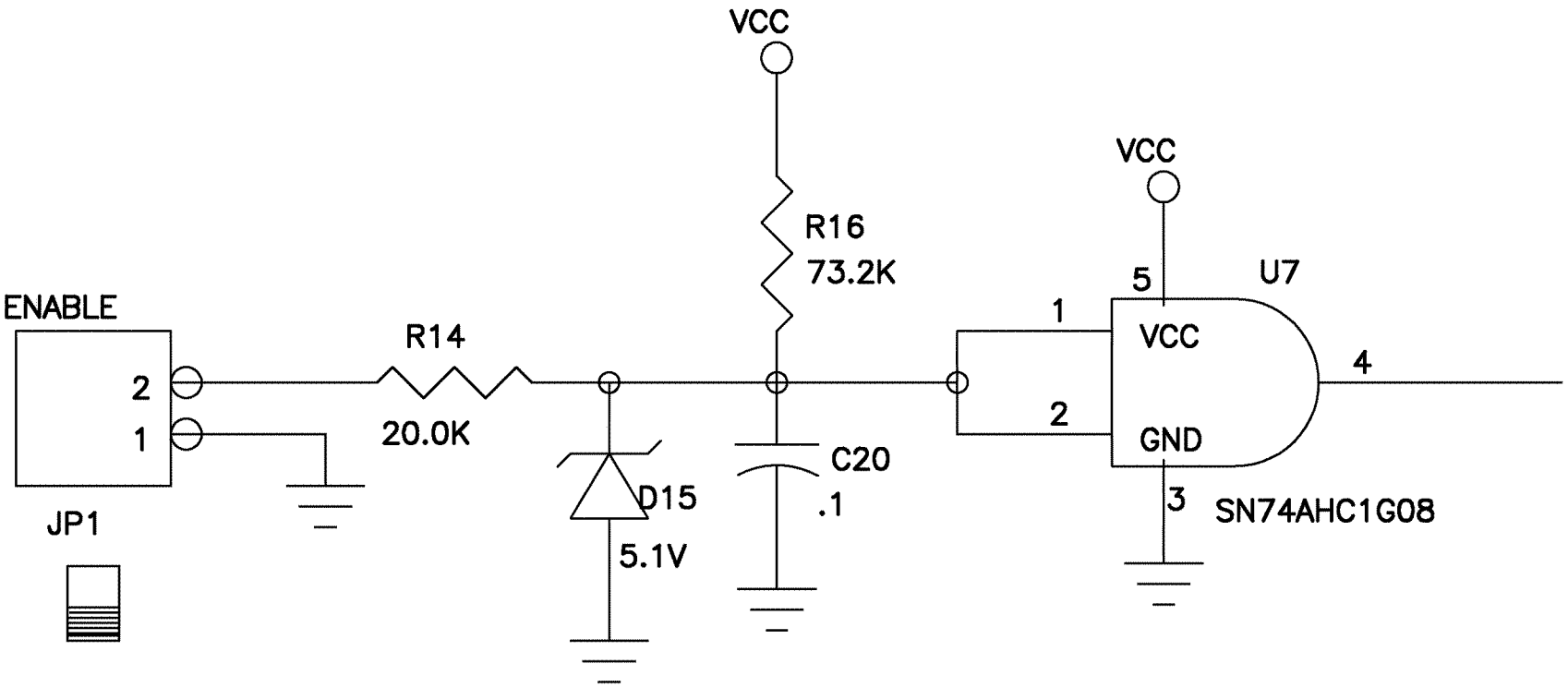
FIG. 24–I

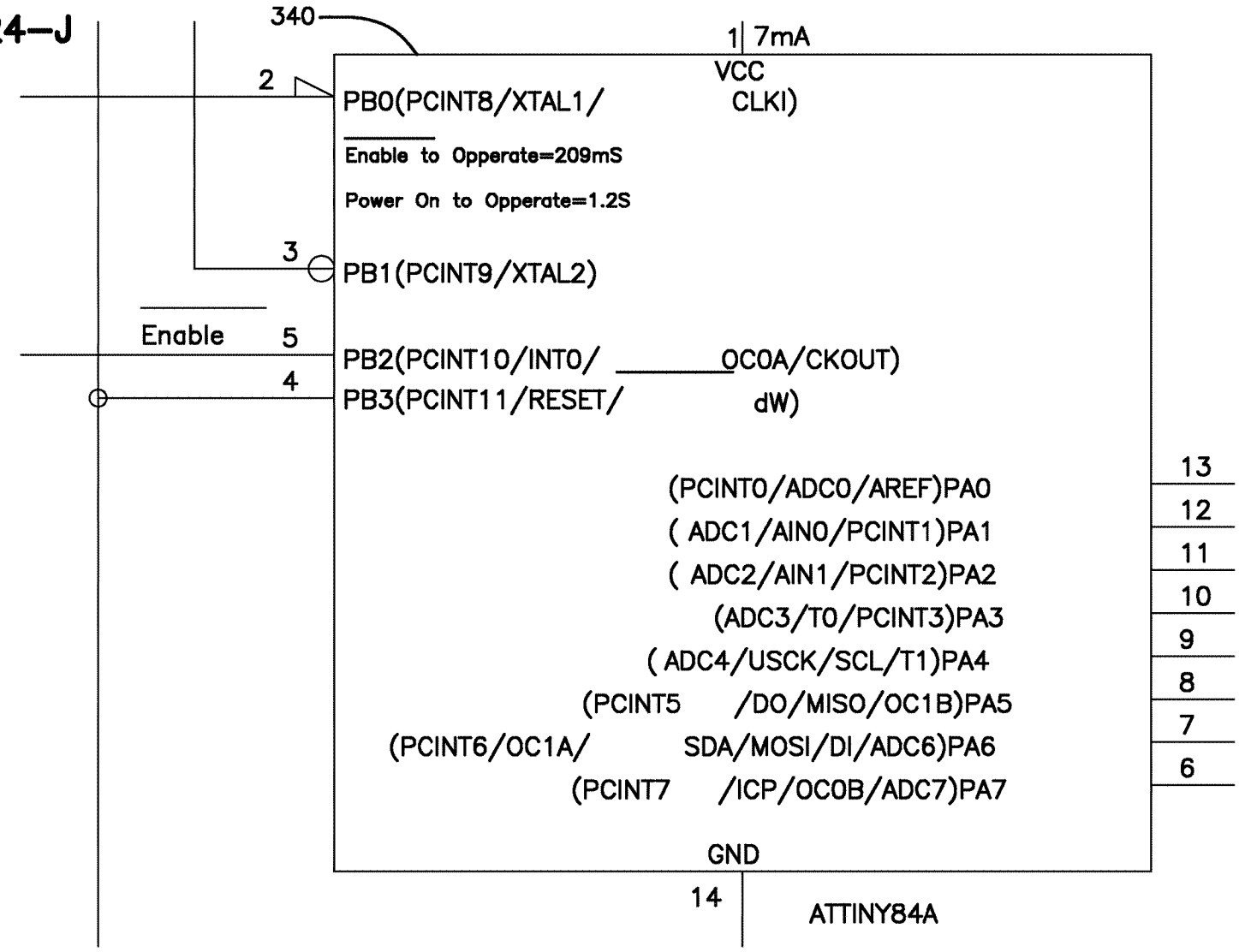
FIG. 24—J

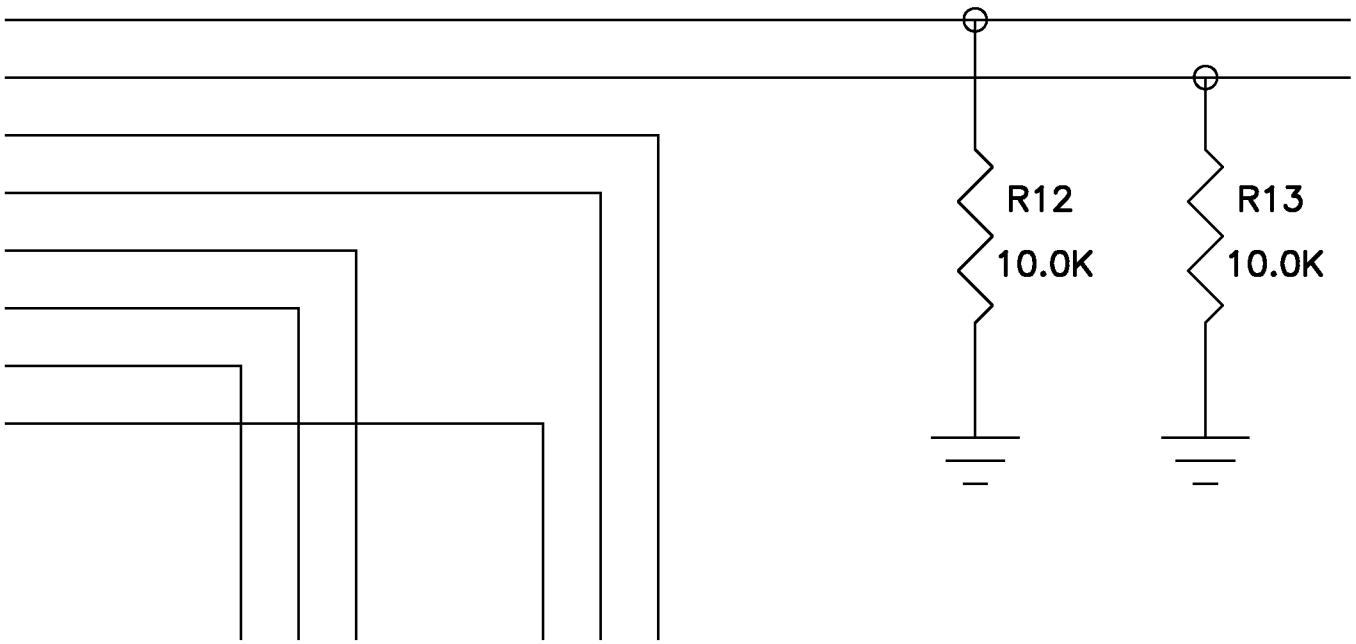
FIG. 24–K

FIG. 24–L
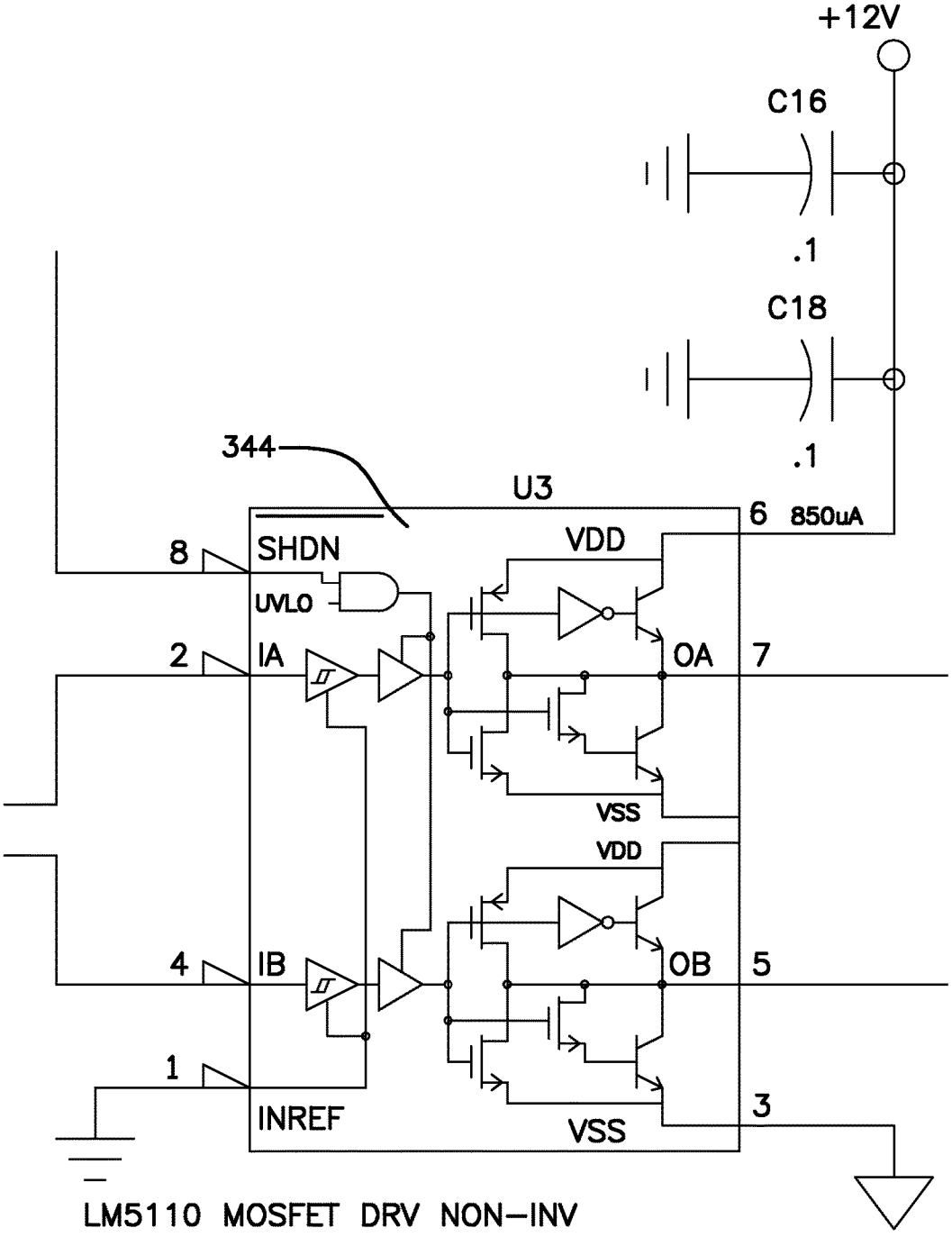

FIG. 24—M
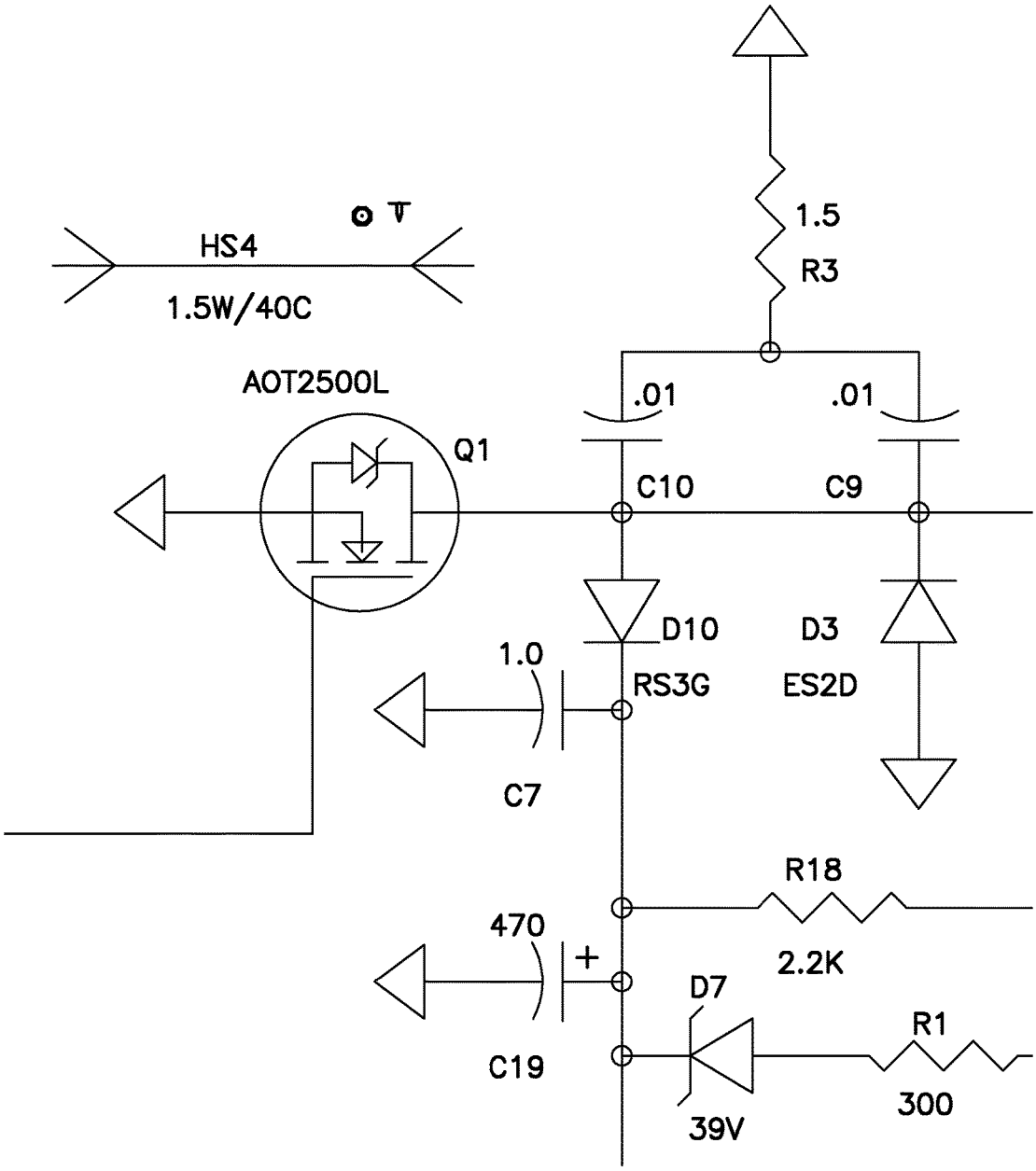

FIG. 24—N
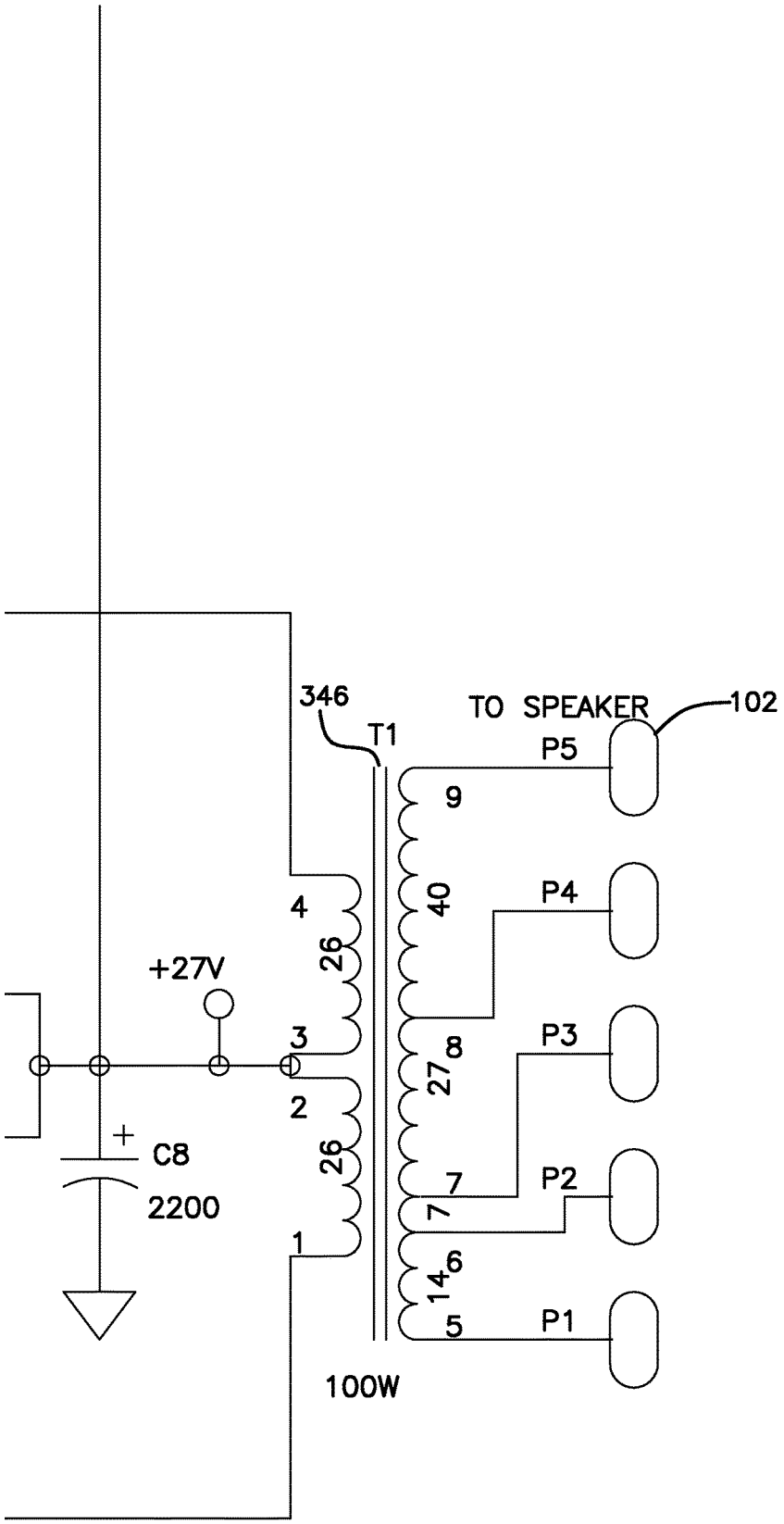

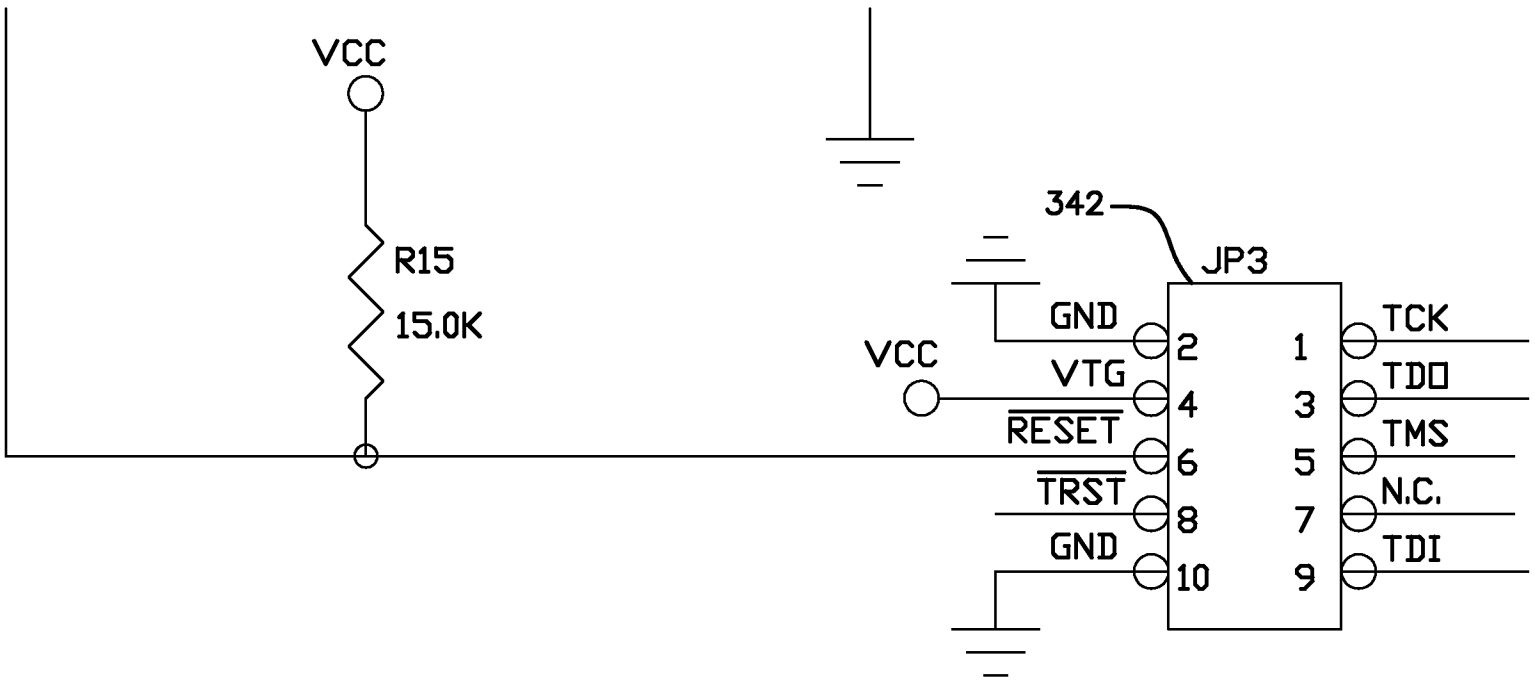
FIG. 24–O

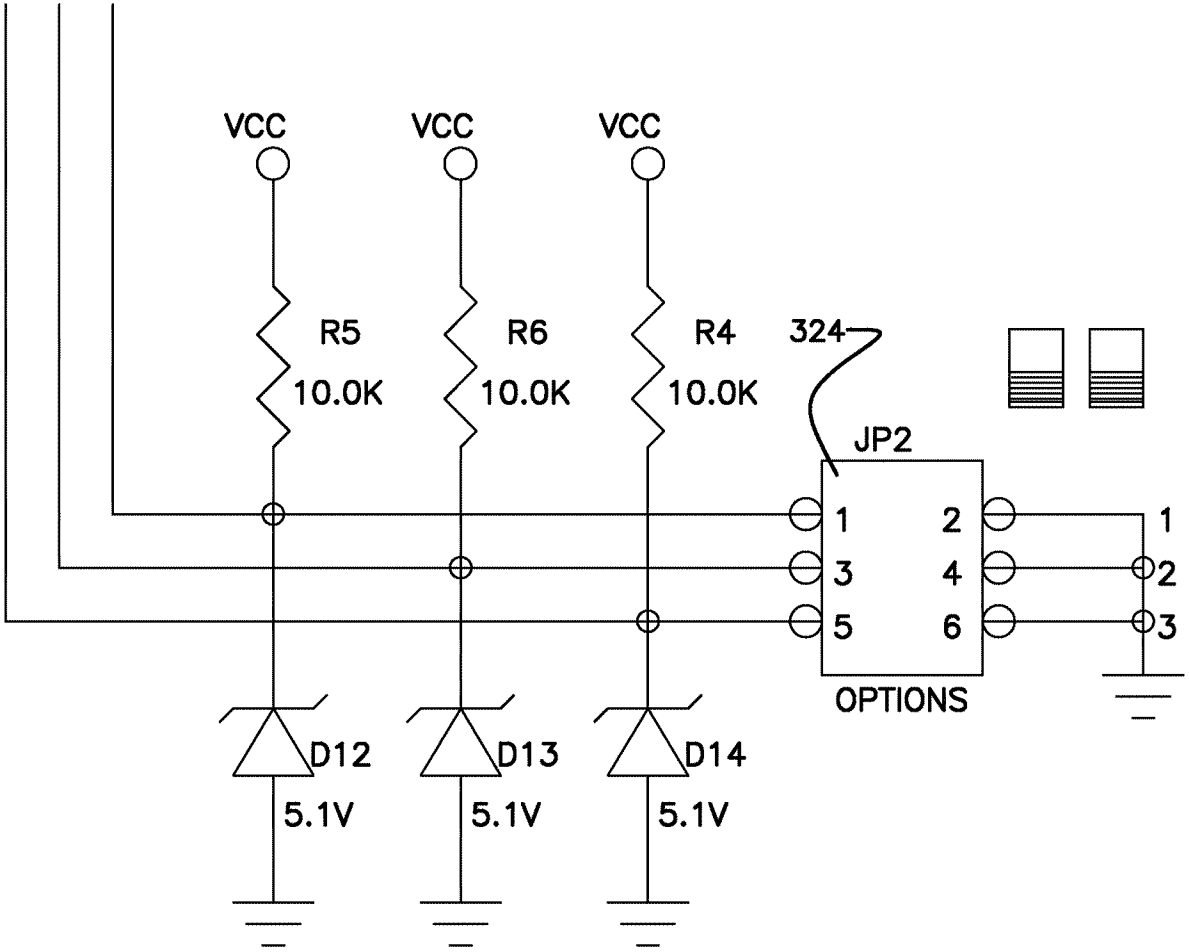
FIG. 24–P

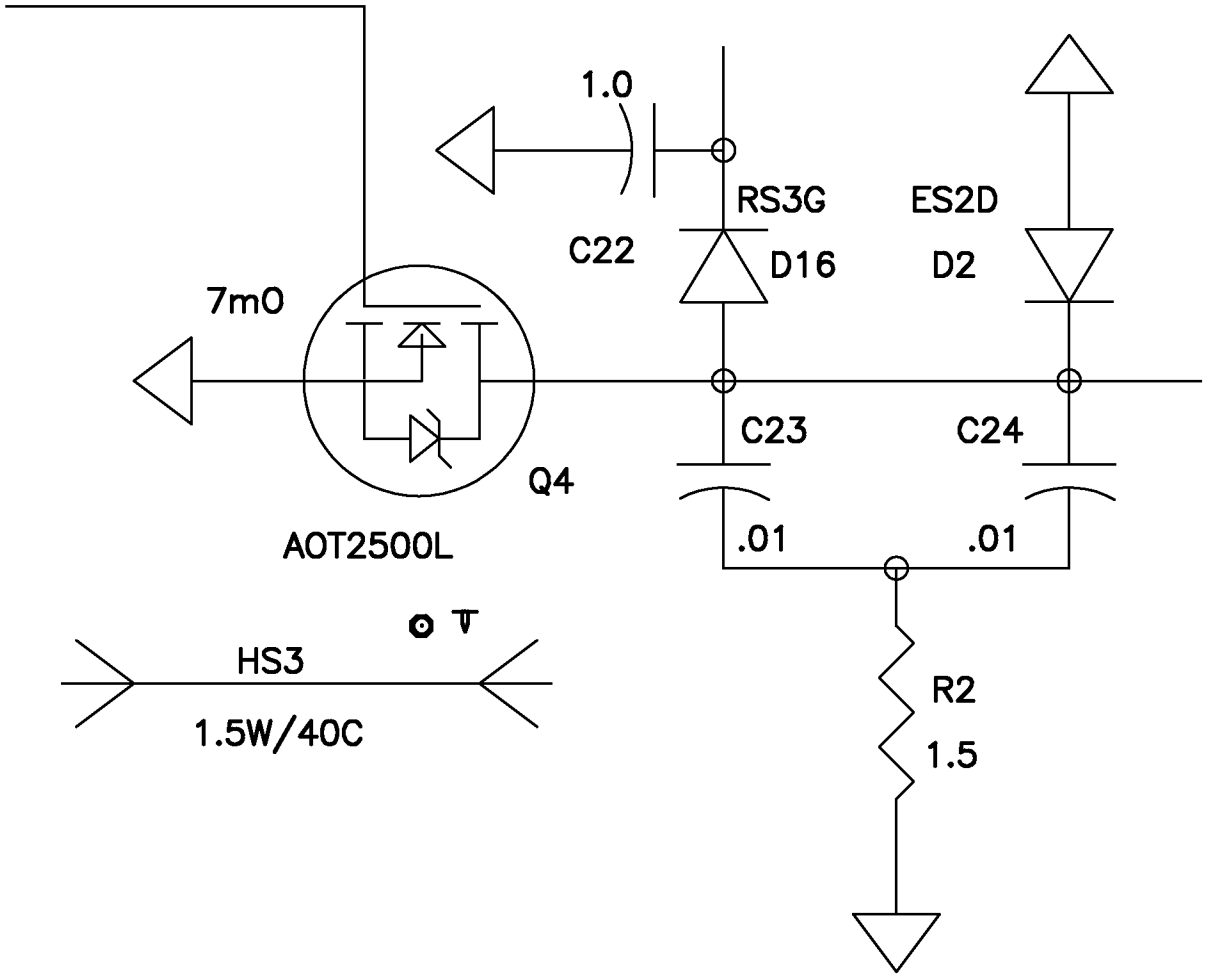
FIG. 24—Q

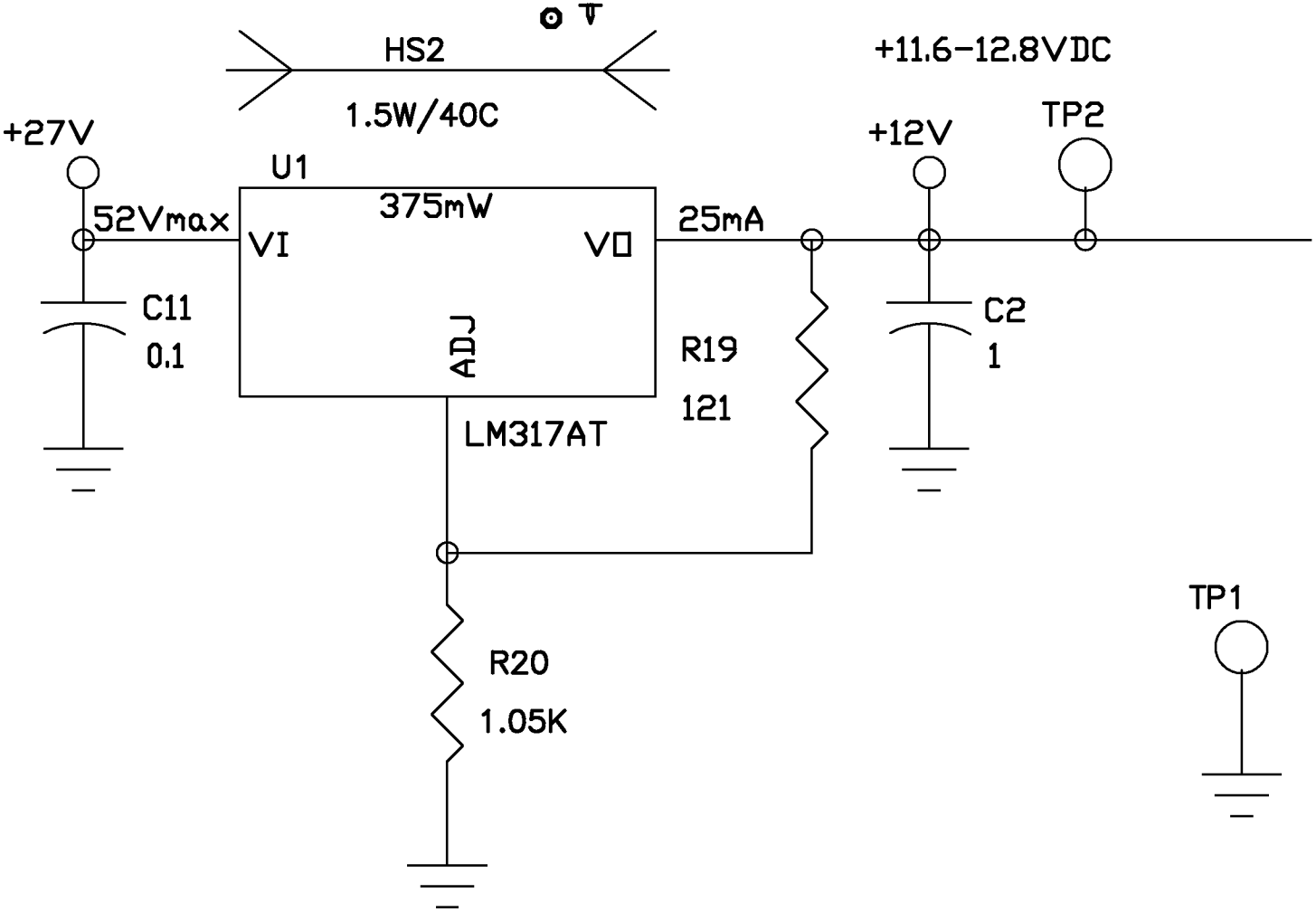
FIG. 24-R

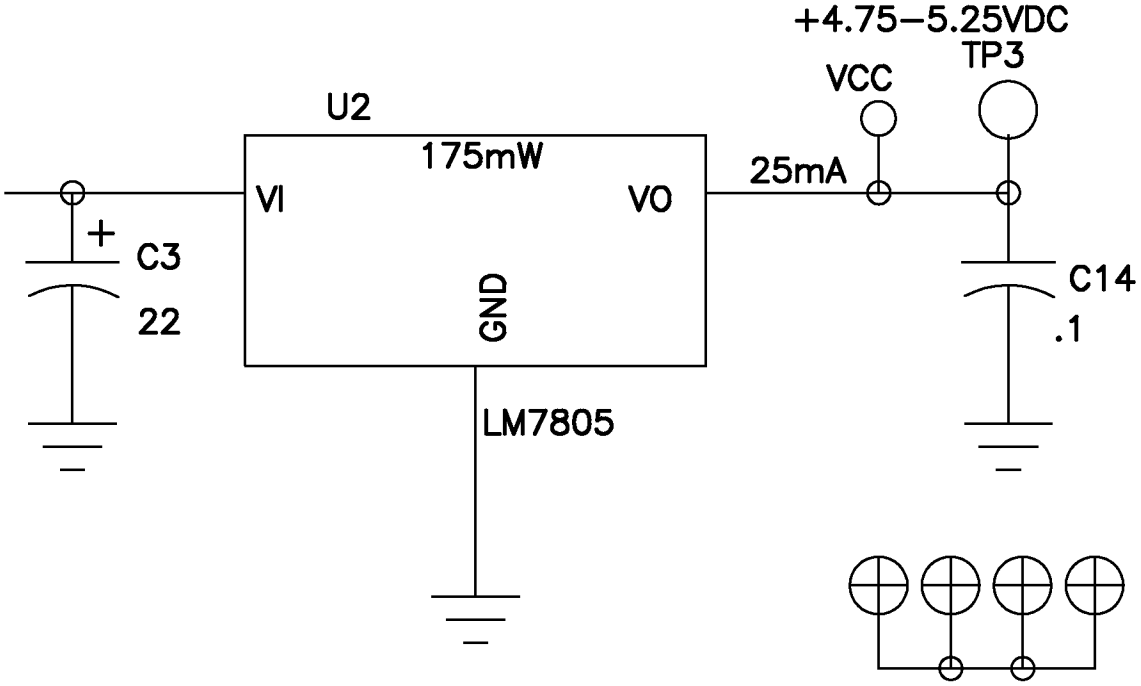
FIG. 24–S

TONE GENERATION

BACKGROUND

Mechanical sirens, horns, buzzers, etc. provide distinctive sounds used in various applications such as signaling tones (lunch or break time indicators in factories), warning tones or sirens (severe weather warnings), indicators for sports events in stadiums and arenas (scoreboard buzzer), etc.

An example of an electromechanical device for producing such sounds includes a flexible diaphragm, typically made of metal, with a striker that is magnetically activated to move the striker against the diaphragm to generate a tone. Some electronic tone production devices reproduce the sound of mechanical horns and buzzers by simply playing an amplified analog or digital recording of the desired sound through a loud speaker system. Such electronic sound production systems typically include an input signal source, an amplifier circuit and a loudspeaker.

Improvements in sound generation systems are desired.

SUMMARY

In accordance with aspects of the present disclosure, a tone generation system includes a square wave signal generator configured to generate a first series of square wave signals to replicate a fundamental frequency of a desired mechanical tone, and a second series of square waves signals to replicate a second harmonic of the desired mechanical tone. An amplifier is configured to receive the first and second series of square waves, and a speaker is connected to receive an output signal from the amplifier.

In accordance with further aspects of the present disclosure, a tone generation method includes generating a first series of square wave signals to replicate a fundamental frequency of a desired mechanical tone, and generating a second series of square waves signals to replicate a second harmonic of the desired mechanical tone. In some implementations, a plurality of series of square wave signals are generated to replicate a respective plurality of harmonics of the desired mechanical tone. The square wave signals are sent to an amplifier, and the amplified signals are played through a speaker.

BRIEF DESCRIPTION OF THE DRAWINGS

FIG. 11 is a block diagram illustrating an example of a tone generation system in accordance with aspects of the present disclosure.

FIG. 12 illustrates an analog waveform of a mechanically-produced tone to be replicated.

FIGS. 22A-22G are close-up views of respective sections of the circuit shown in FIG. 22.

FIGS. 23A-23J are close-up views of respective sections of the circuit shown in FIG. 23.

FIGS. 24A-24S are close-up views of respective sections of the circuit shown in FIG. 24.

DETAILED DESCRIPTION

In the following Detailed Description, reference is made to the accompanying drawings, which form a part hereof, and in which is shown by way of illustration specific embodiments in which the invention may be practiced. In this regard, directional terminology, such as top, bottom, front, back, etc., is used with reference to the orientation of the Figure(s) being described. Because components of embodiments can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense.

Some electronic tone production devices reproduce the sound of mechanical horns and buzzers by simply playing an amplified analog or digital recording of the desired sound through a loud speaker system. Such electronic sound production systems typically include an input signal source, an amplifier circuit and a loudspeaker.

With digital sound recording, digital audio is directly recorded to a storage device as a stream of discrete numbers. The analog sound signal is transmitted from an input device to an analog-to-digital converter (ADC), which converts the signal by repeatedly measuring the momentary level of the analog (audio) wave and then assigning a binary number with a given quantity of bits (word length) to each measuring point. The frequency at which the ADC measures the level of the analog wave is called the sample rate, and a digital audio sample with a given word length represents the audio level at one moment. To playback the sound, the binary numbers are transmitted from the storage device into a digital-to-analog converter (DAC), which converts the numbers back to an analog signal using the information stored in each digital sample, thus rebuilding the original analog waveform. This signal is then amplified and played through loudspeakers.

Some form of data storage is required for storing the recorded sounds, as well as complicated processing devices and associated circuitry. Further, reproducing the sounds in this manner requires a complicated and powerful amplifier, which requires bigger devices that generate undesirable heat and consume considerable power.

Figure 1:
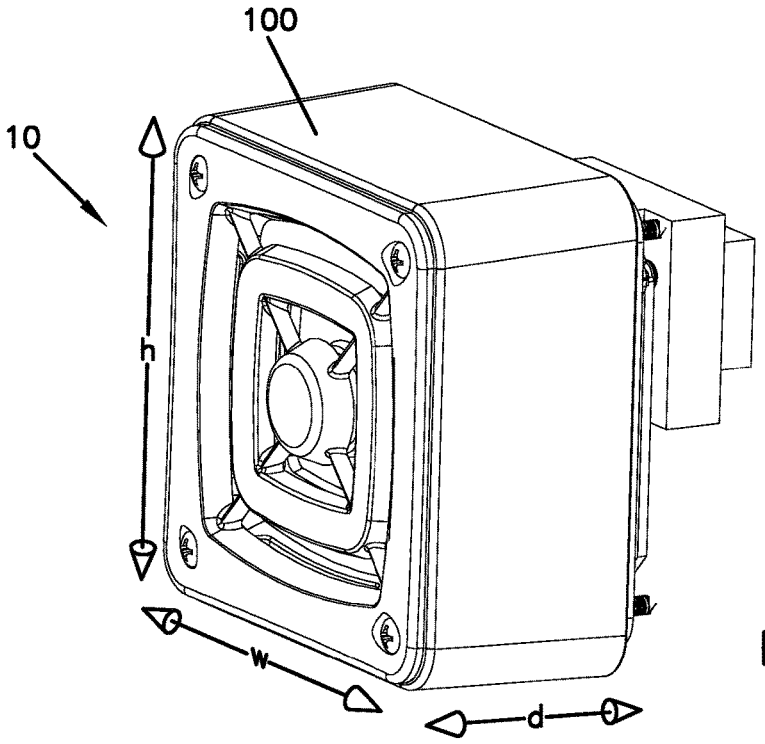
FIG. 1 is a perspective view illustrating an example of a tone generation system in accordance with aspects of the present disclosure.
Figure 2:
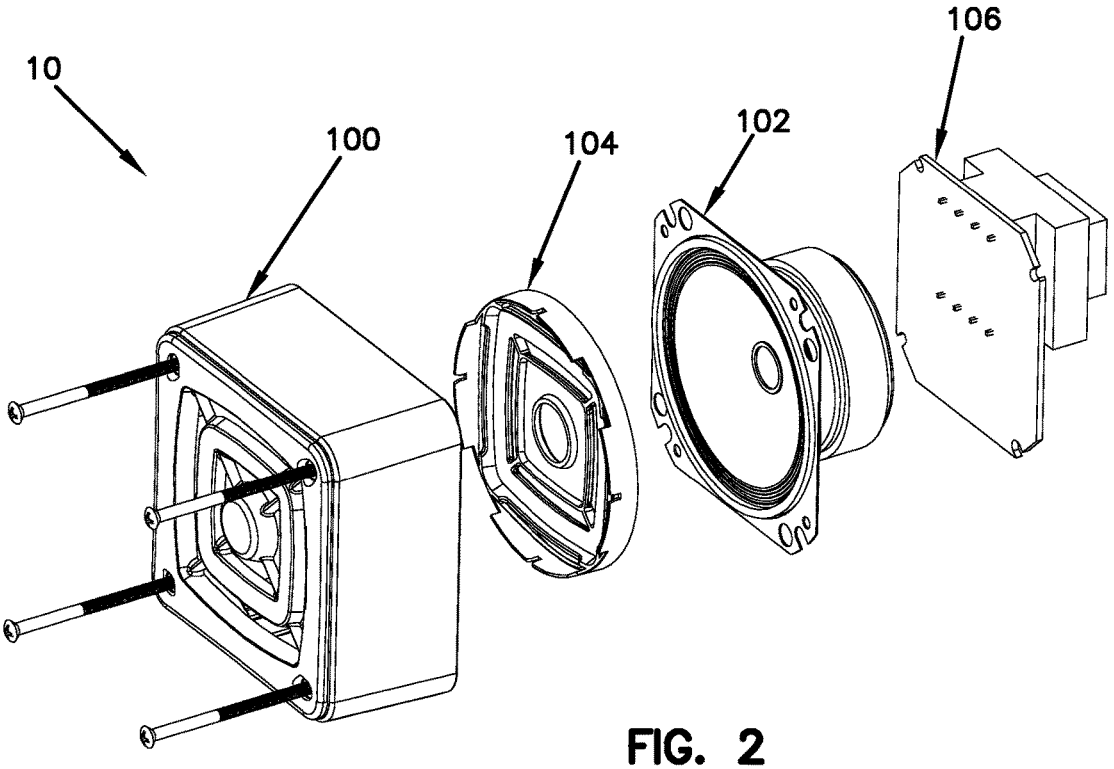
FIG. 2 is an exploded view of the system shown in FIG. 1.

Various examples of sound generation systems are disclosed herein, where a small, portable system is provided that replicates mechanically produced sounds such as buzzers, horns, sirens, etc. FIGS. 1 and 2 illustrate one example system 10 that includes a housing 100, a speaker 102, a baffle 104 and a circuit board assembly 106. In some examples, the height h, width w and depth d dimensions of the system 10 are all less than 5 inches, and in one particular implementation the dimensions are 4.40×4.40×3.53 inches.

Figure 3:
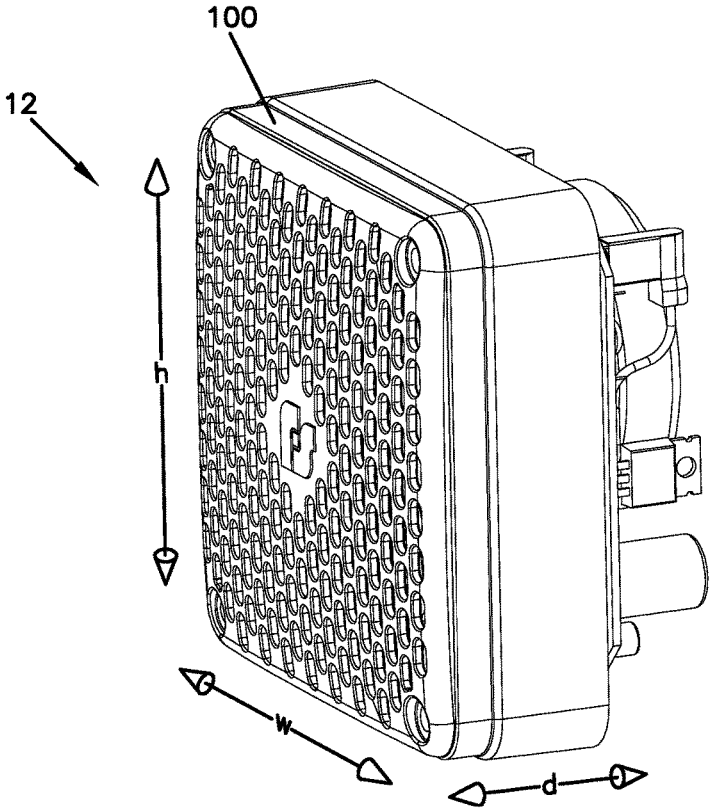
FIG. 3 is a perspective view illustrating an example of another tone generation system in accordance with aspects of the present disclosure.
Figure 4:
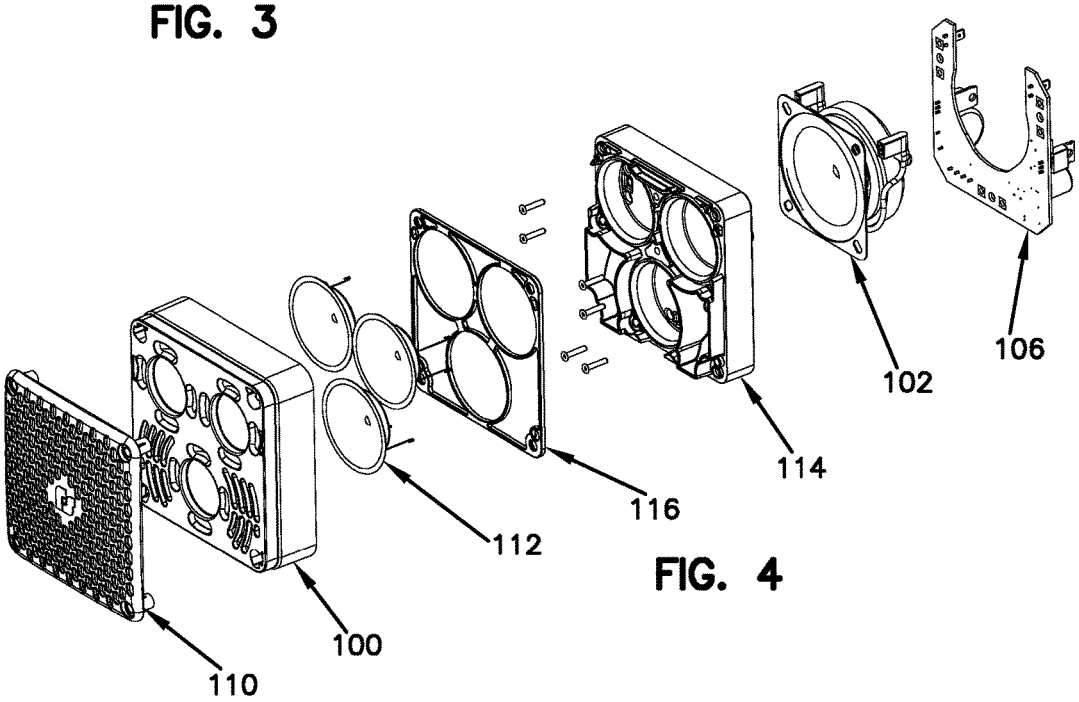
FIG. 4 is an exploded view of the system shown in FIG. 3.

FIGS. 3 and 4 illustrate another example system 12 that also includes a housing 100, a speaker 102 and a circuit board assembly 106, as well as a grille 110 situated over the housing 100. The system 12 further includes piezoelectric devices 112 in addition to the speaker 102 for playing the desired sounds. The piezoelectric devices 112 are received in a frame 114 with a gasket 116 positioned between the piezoelectric devices 112 and the frame 114. In some examples, the height h, width w and depth d dimensions of the system 12 are all less than 5 inches, and in one particular implementation the dimensions of the system 12 are 4×4×2.8 inches.

Figure 5:
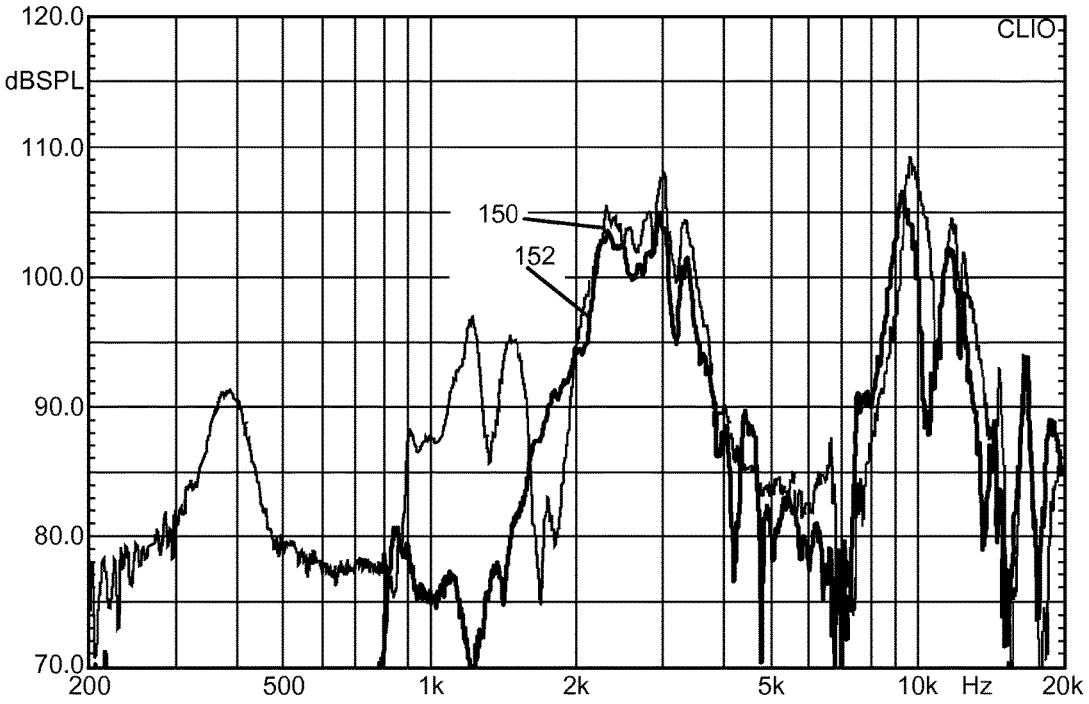
FIG. 5 is a plot illustrating sound pressure levels.

The example shown in FIGS. 3 and 4 includes a 2.5 inch, 25 ohm speaker 102 with a frequency response of 200 Hz to 5 kHz (−10 dB). Three piezoelectric horn drivers 112 are received in the frame 114 so as to position the piezoelectric devices 112 in front of the cone of the speaker 112 to allow the low frequency sound from the moving coil speaker 112 to pass between the piezoelectric devices 112 and obtain the desired frequency response and sound pressure level while minimizing the a small physical size of the package. FIG. 5 compares sound pressure levels across a frequency range for a device such as that illustrated in FIGS. 3 and 4 (plot 150), compared to a device using only piezoelectric drivers (plot 152). As shown in FIG. 5, the inclusion of the cone speaker 102 significantly increases the sound pressure level at lower frequencies (e.g., below about 1,700 Hz).

FIGS. 6A-D illustrate the speaker 102 and the piezoelectric devices 112 of the example system 12 shown in FIG. 3. As noted above, the three piezoelectric devices 112 are positioned in front of the cone of the speaker 112 to allow the low frequency sound from the moving coil speaker 112 to pass between the piezoelectric devices 112. More particularly, in the illustrated example, the speaker 102 is connected to receive an output signal from an amplifier to generate a desired tone as discussed further herein below. The speaker 102 includes a speaker cone 130 connected to a frame 132 such that the cone 130 can move (vibrate) relative to the frame 132 in response to the signal received from the amplifier. A magnet 134 is situated adjacent one side of the speaker cone 130 opposite the frame 132.

The speaker 102 defines a speaker diameter SD, which in the illustrated example is about 2.6 inches. The piezoelectric drivers 112 are adjacent the speaker cone, opposite the frame 132 and magnet 134. The piezoelectric drivers 112 each define a driver diameter PD, which is about 1.9 inches in the illustrated example. The piezoelectric drivers 112 are arranged such that a first portion of each driver diameter is within the speaker diameter and a second portion of each driver extends beyond the speaker diameter. In other words, if an imaginary cylinder were extended from the periphery of the speaker 102, a portion of each piezoelectric driver 112 would be within the cylinder and a portion of each piezoelectric driver 112 would extend beyond the cylinder. In FIG. 6C, a broken line 140 defines the speaker diameter and represents such a cylinder. Thus, each of the piezoelectric drivers 112 has a first portion 112*a* inside the speaker diameter 140 and a second portion 112*b* extending outside the diameter 140.

Figure 6A:
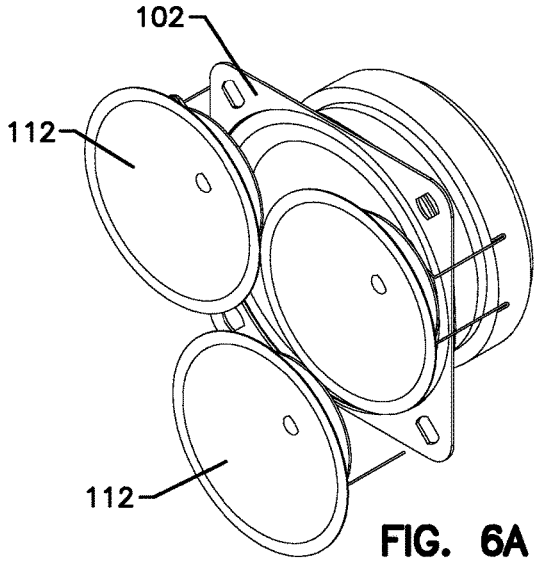
FIGS. 6A-6D illustrate examples of the speaker and piezoelectric drivers shown in FIG. 4.
Figure 6B:
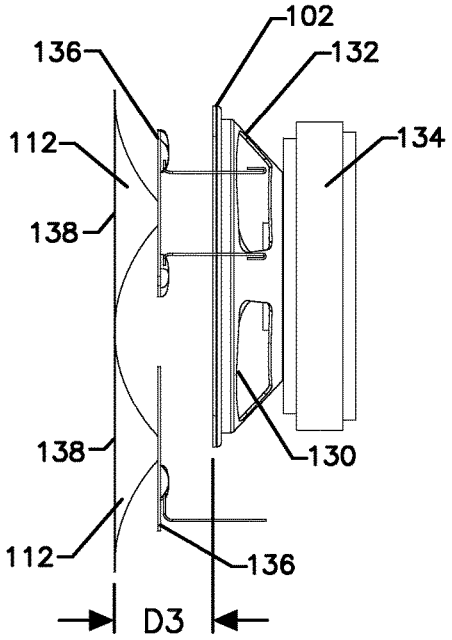
Figure 6C:
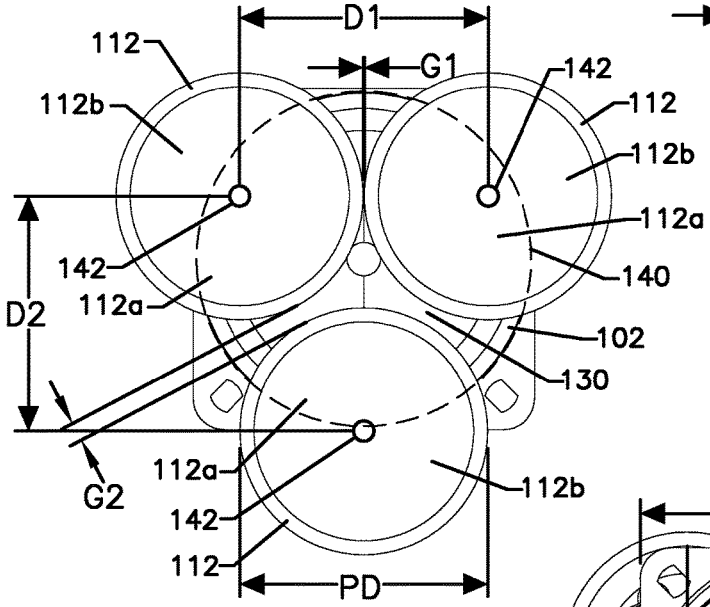
Figure 6D:
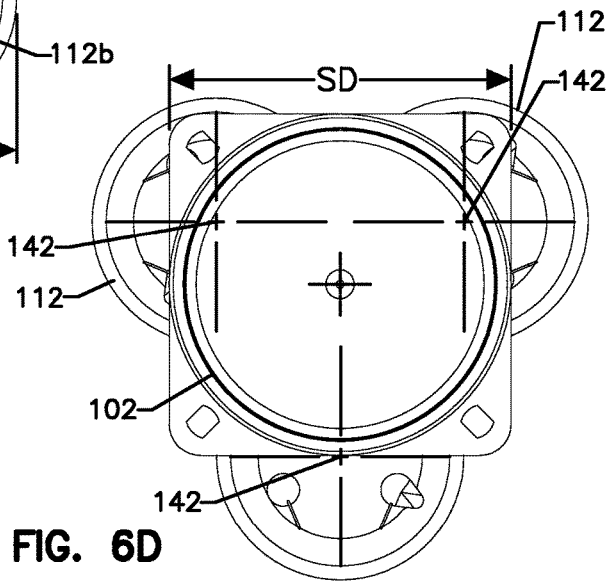
Figure 7:
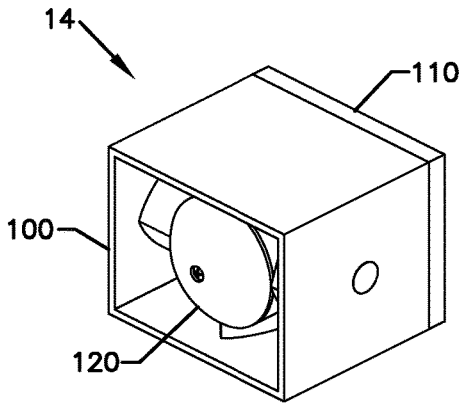
FIG. 7 is a first perspective view illustrating an example of another tone generation system in accordance with aspects of the present disclosure.
Figure 8:
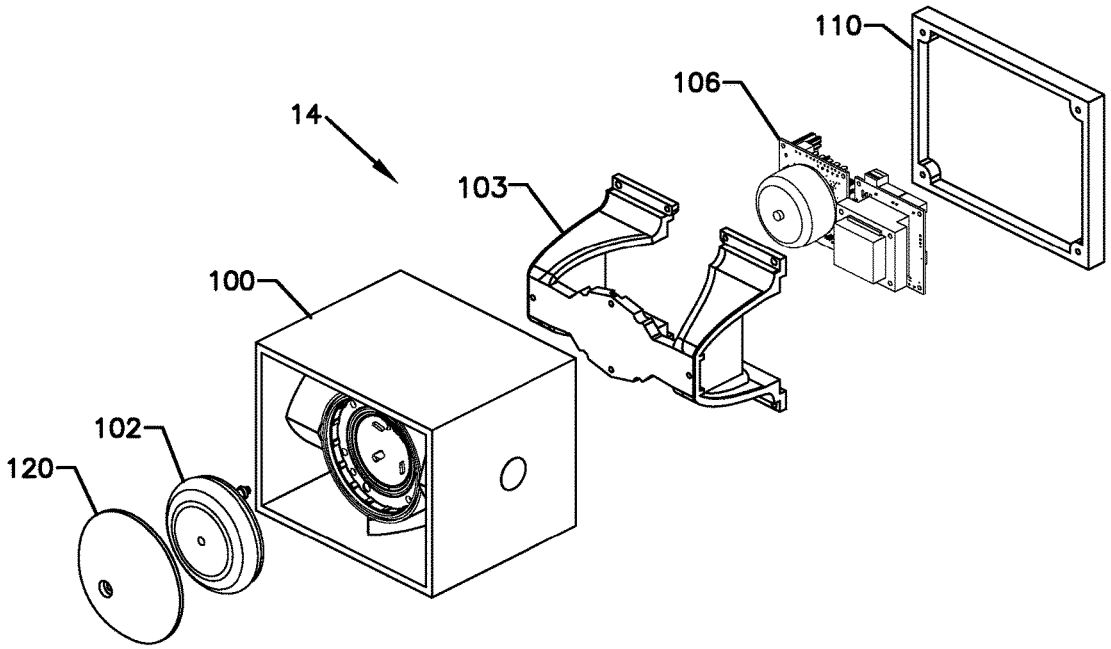
FIG. 8 is an exploded view of the system shown in FIG. 7.
Figure 9:
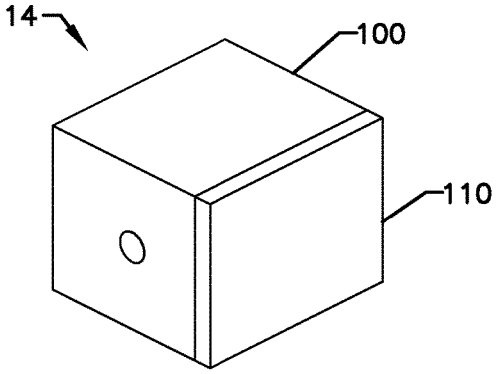
FIG. 9 is a second perspective view illustrating the tone generation system shown in FIGS. 7 and 8.
Figure 10:
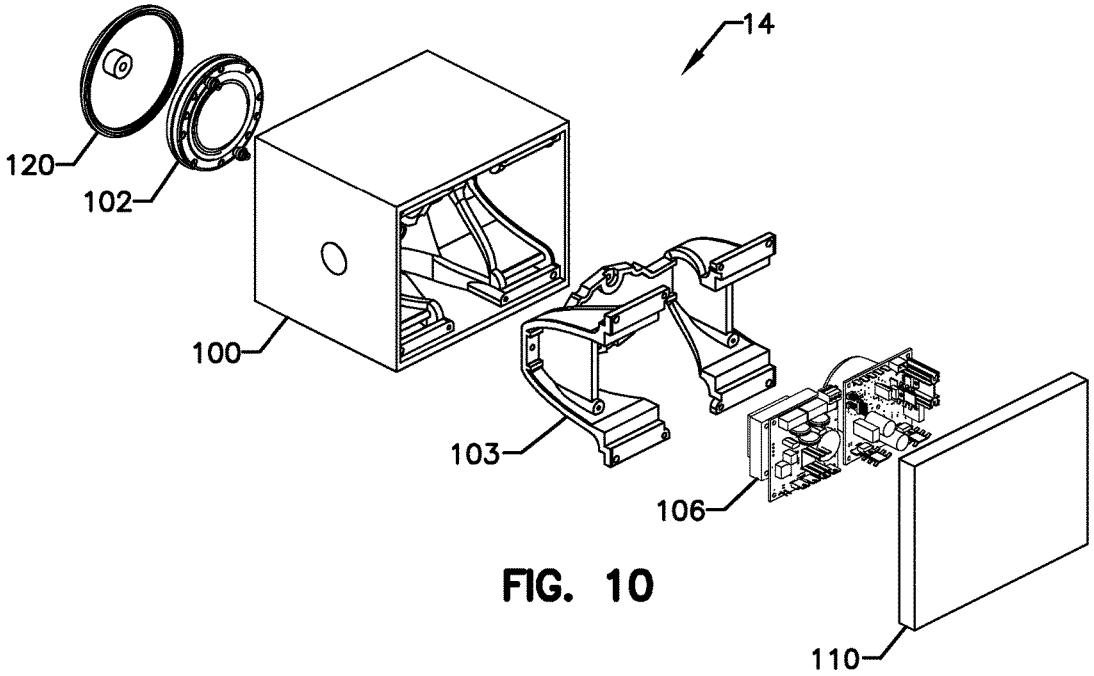
FIG. 10 is another exploded view of the system shown in FIG. 9.

As shown in FIG. 6B, each of the piezoelectric drivers 112 includes a piezoelectric bimorph 136 with a cone 138 attached thereto. Each of the cones 138 of the piezoelectric drivers 112 defines a center axis 142, and in some embodiments, at least one of the piezoelectric drivers 112 has its center axis 142 situated within the speaker diameter SD. In the illustrated example, two of the center axes 142 are completely within the speaker diameter SD and the lower piezoelectric driver 112 shown in FIGS. 6C and 6D has its axis on the periphery 140 of the speaker diameter SD.

As noted above, gaps between the piezoelectric drivers 112 are provided to allow sound from the speaker 112 to pass between the piezoelectric drivers 112. In the illustrated example, the top two piezoelectric drivers 112 are positioned with a minimal gap G1 therebetween, less than 0.1 inches in the illustrated example. A larger second gap G2 is provided between the top piezoelectric drivers 112 and the bottom driver 112, about 0.14 inches in the example of FIG. 6C. The illustrated piezoelectric drivers 112 each have a diameter PD of about 1.9 inches, and the distance D1 between the centers 142 of the top piezoelectric drivers 112 is thus also about 1.9 inches or slightly larger to achieve the small gap G1 between the horizontally-aligned top devices 112. The distance D2 between the centers 142 of the top piezoelectric devices 112 and the bottom piezoelectric device 112 center 142 is about 1.8 inches. As shown in FIG. 6B, the piezoelectric drivers 112 are situated such that there is a distance D3 between the front of the piezoelectric driver cones 138 and the front of the speaker cone 132 so as to provide space between the piezoelectric drivers 112 and the speaker 102 in an axial direction. In the example of FIG. 6B, the distance D3 is about 0.8 inches.

FIGS. 7-10 illustrate yet another example system 14. The system 14 includes a main housing 100, as well as an inner housing 103. The main housing 100 receives a driver speaker 102 and driver cap 120. A rear housing 110 is positioned opposite the main housing 100. A circuit board assembly 106 is situated between the rear housing 110 and the inner housing 103. In one particular implementation, the height h, width w and depth d dimensions of the system 14 are about 7 inches, 9 inches and 8.7 inches, respectively. The example system 14 illustrated in FIGS. 7-10 uses a compression driver loudspeaker, in which the housing components 100 and 103 form a horn that receives the driver speaker 102 and driver cap 120.

The illustrated example systems 10, 12, 14 are each configured to produce tones that replicate the sounds of desired mechanical sound production devices. The disclosed systems produce tones with a frequency harmonic content and thus create sounds that are similar to mechanical sirens and horns, for example. In some embodiments, this is done through the use of a combination of square wave signals compiled into a train of varying pulse widths and spaces to generate the desired harmonics while controlling the polarity of the pulses at key points in the waveform to re-enforce or suppress other harmonics.

FIG. 11 is a block diagram conceptually illustrating further aspects of the systems 10,12,14. Generally, each of the systems 10,12,14 include a power input section 200 that is configured to receive an AC or DC voltage, depending on the particular configuration. A signal generator 202 generates electrical signals to create a predetermined sound, and the signals output by the signal generator 202 are received by an amplifier 204 that provides amplified signals to the speaker 102.

In some implementations, the signal generator 202 is a square wave generator that is configured to generate a first series of square wave signals that replicate a fundamental frequency of a desired mechanical tone, and also to generate further series of square waves signals to replicate respective harmonics of the desired mechanical tone. Because the signal output by the square wave generator 202 is comprised of square waves, it allows for the use of a simple digital amplifier 204 that then applies the modulated pulse train to a speaker. This avoids the inefficiency and heat produced by linear amplifiers and the complexity of class "D" PWM amplifiers. This simplicity improves reliability and durability over that of mechanical sirens, horns and buzzers and reduces size and cost.

Figure 13:
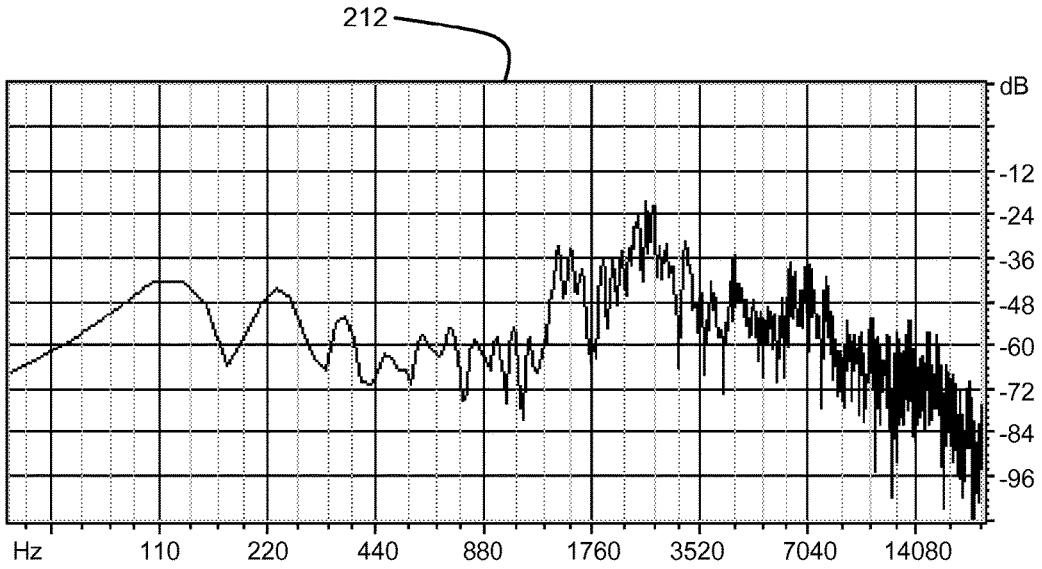
FIG. 13 is a scope screen shot illustrating an example of an analysis of the analog waveform shown in FIG. 12.

In some implementations, the pulse width and spacing for the various series of square wave signals are determined by analyzing the sound to be replicated. For example, an inverse Fourier transform can be performed on the sound to be replicated to determine the fundamental frequency and harmonics and their associated levels. FIG. 12 shows an analog waveform 210 of a mechanically-produced tone to be replicated. The mechanical device that produced the tone includes a metal diaphragm being struck 120 times per second. The diaphragm rings at a fundamental frequency and the metal forming the diaphragm adds harmonics. FIG. 13 is a scope screen shot 212 illustrating an example of an analysis of the analog waveform 210. The desired mechanical tone is thus analyzed to determine the fundamental frequency and level thereof, as well as frequency and level of the desired harmonics.

Figure 14:
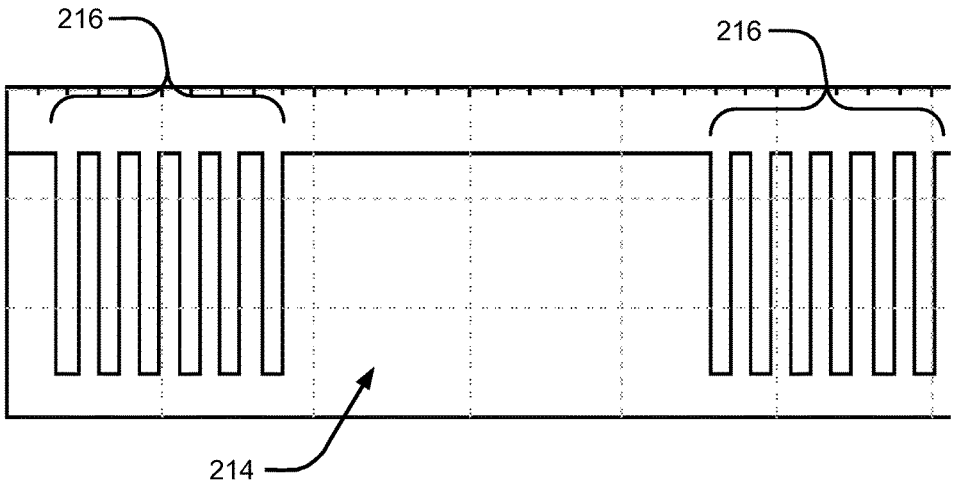
FIG. 14 illustrates an example of a square wave signal generated in accordance with aspects of the present disclosure.

FIG. 14 illustrates an example of a square wave signal 214 output by the square wave generator 202 to replicate the sound represented by the waveform 210 shown in FIG. 12. The square wave signal 214 includes groups of pulses 216. In one example, the pulses in the groups 216 produce a tone with a fundamental frequency of 1900 Hz, and the width of the pulses sets the strength of the fundamental and the second and third harmonics. Further, the fundamental is chosen to be the frequency where the cone of the speaker 102 will ring and add harmonics. The groups of pulses 216 are turned on and off 120 times per second to reproduce the sound of the metal diaphragm being rung 120 times per second.

Figure 15:
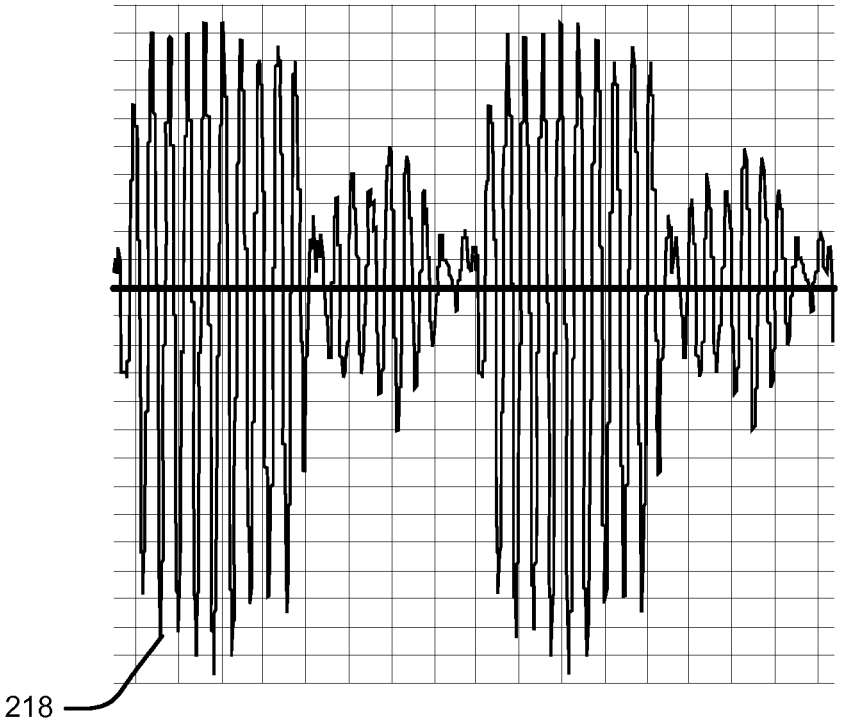
FIG. 15 illustrates an analog waveform of the sound produced by a square wave signal generated in accordance with aspects of the present disclosure.
Figure 16A:
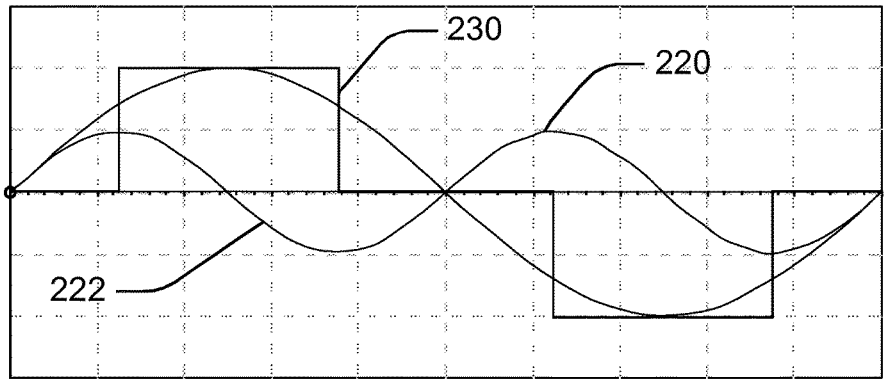
FIG. 16A is a chart showing sinusoidal waveforms representing a fundamental frequency and a harmonic, and a generated square wave.
Figure 16B:
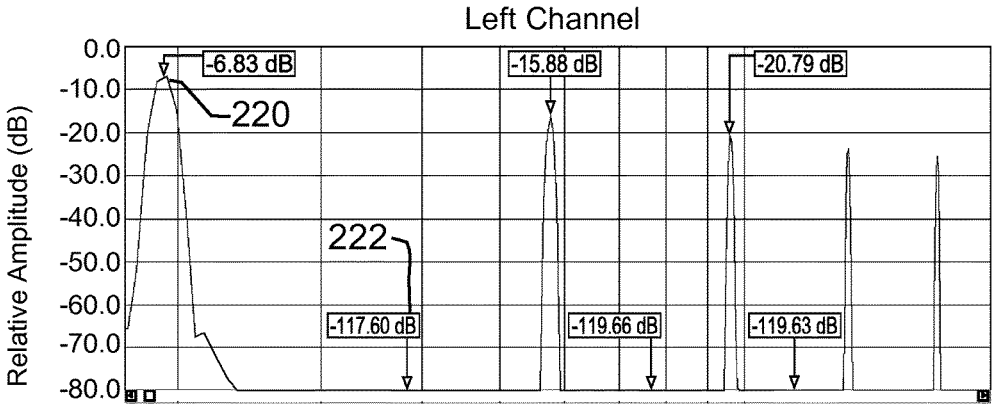
FIG. 16B is a chart illustrating resultant amplitude levels for the fundamental frequency and harmonics shown in FIG. 16A.
Figure 17A:
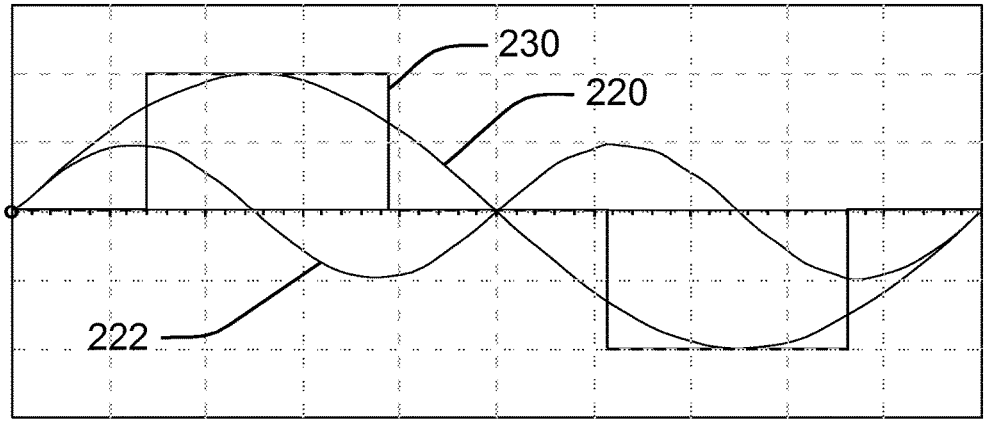
FIG. 17A is a chart showing the pulse width and gap of the square wave modified from the square wave shown in FIG. 16A.
Figure 17B:
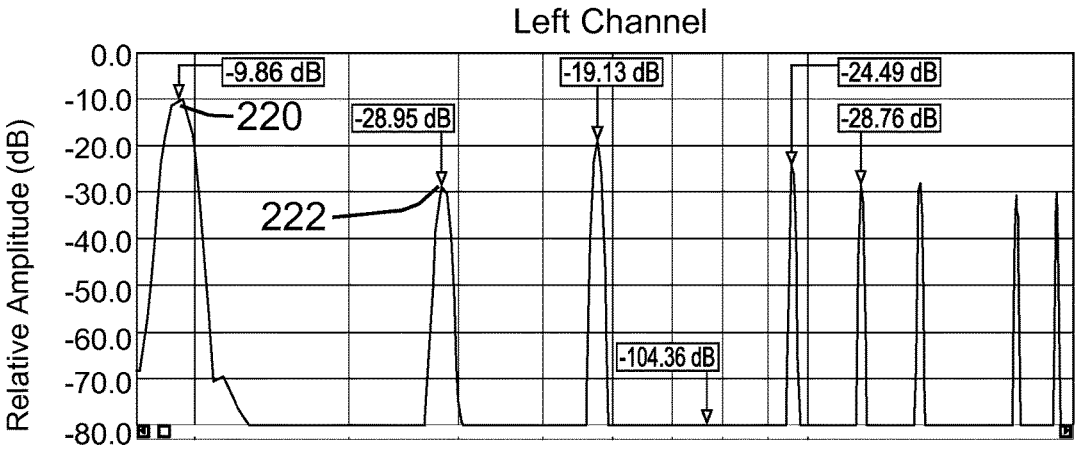
FIG. 17B is a chart illustrating resultant amplitude levels for the fundamental frequency and harmonics shown in FIG. 17A.
Figure 18A:
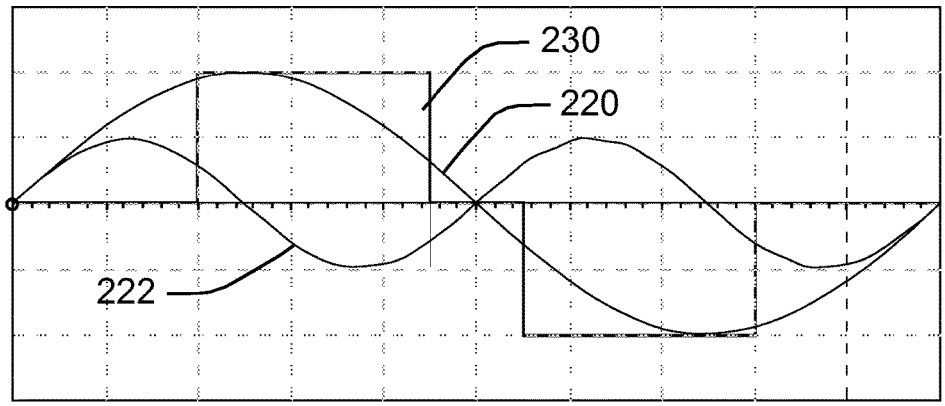
FIG. 18A is a chart showing the pulse width and gap of the square wave modified from the square wave shown in FIGS. 16A and 17A.
Figure 18B:
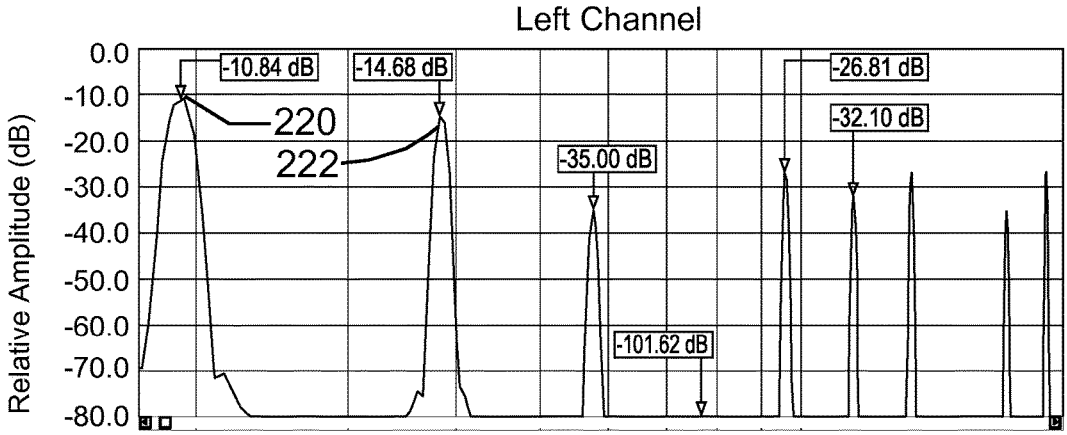
FIG. 18B is a chart illustrating resultant amplitude levels for the fundamental frequency and harmonics shown in FIG. 17B.

FIG. 15 shows an analog waveform of the sound produced by the square wave signal 214 amplified and played through the speaker 201. In some implementations, the process of determining the various aspects of the square wave signal 214 includes analyzing the analog waveform 218, and adjusting the pulse width and/or polarity of the square wave signals based on the analysis. The waveform 218 created by the square wave signal 214 can be compared to the wave form 210 of the mechanically produced tone, and the pulse width and/or polarity of the square wave signals can then be adjusted until the waveforms 214 and 218 are satisfactorily similar.

FIGS. 16-21 conceptually illustrate aspects of a process for creating the square wave signal 214 output by the square wave generator 202. FIG. 16A shows a first sinusoidal waveform representing a fundamental frequency 220 and a second sinusoidal waveform representing a second harmonic 222. A first square wave 230 is shown that is out of phase or has no energy in phase with the second harmonic 222. The first square wave 230 therefore will suppress the second harmonic 222 as shown in FIG. 16B. FIGS. 17A and 18A show the pulse width and gap between pulses of the first square wave 230 changing to move energy into phase with the second harmonic 222, resulting in increased levels of the second harmonic as shown in FIGS. 17B and 18B.

Figure 19A:
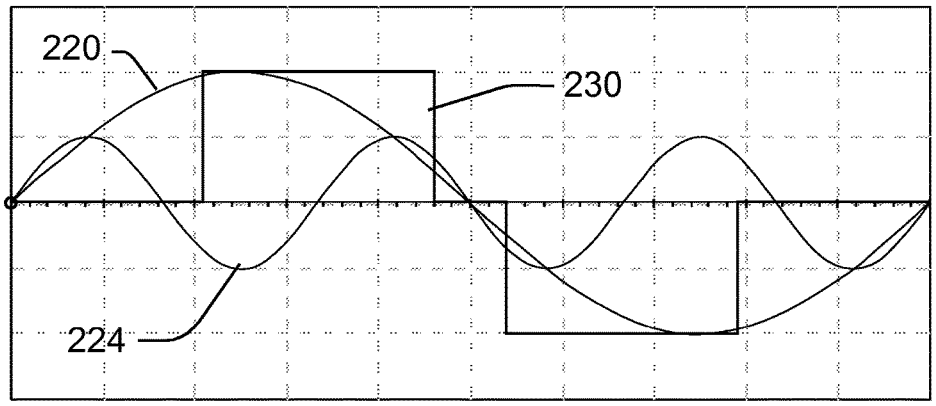
FIG. 19A is a chart showing sinusoidal waveforms representing a fundamental frequency and a harmonic, and a generated square wave.
Figure 19B:
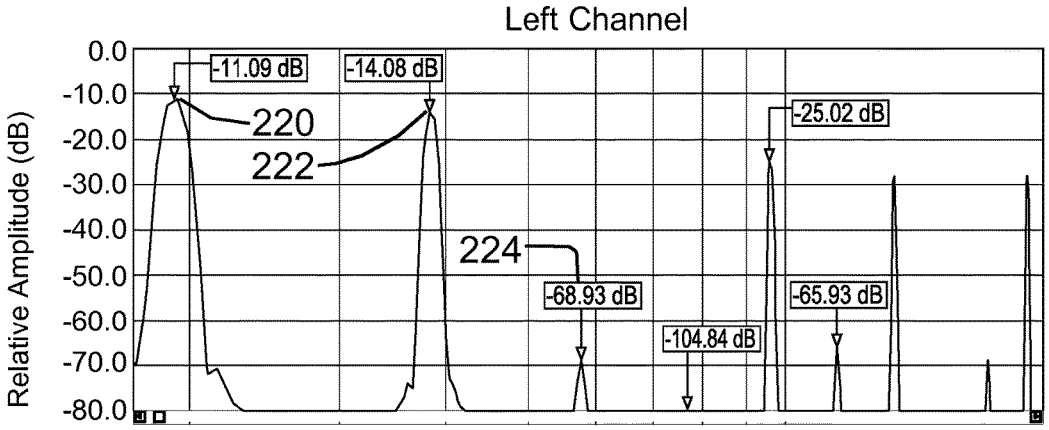
FIG. 19B is a chart illustrating resultant amplitude levels for the fundamental frequency and harmonics shown in FIG. 19A.
Figure 20A:
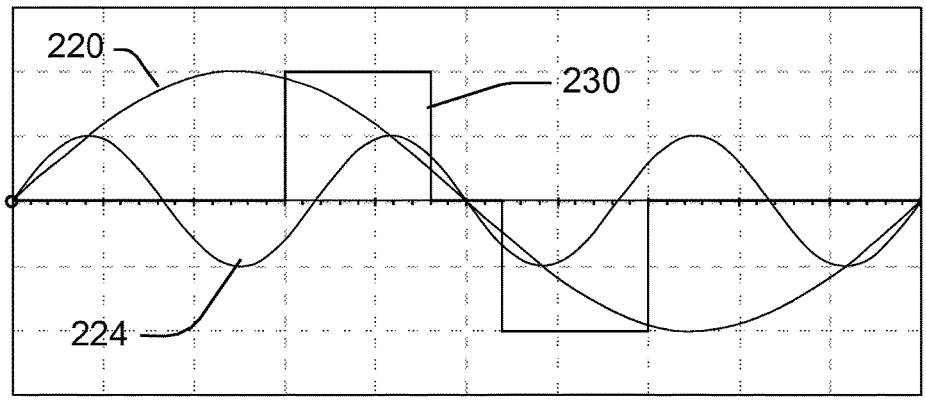
FIG. 20A is a chart showing the pulse width and gap of the square wave modified from the square wave shown in FIG. 19A.
Figure 20B:
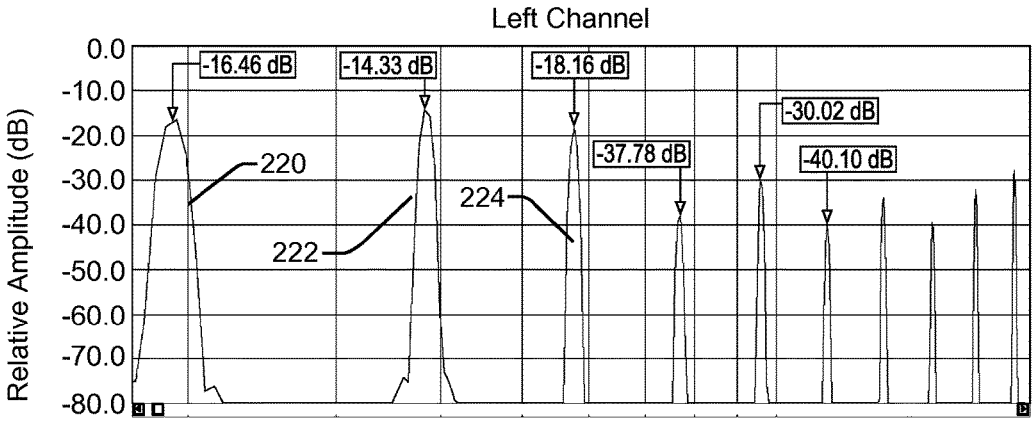
FIG. 20B is a chart illustrating resultant amplitude levels for the fundamental frequency and harmonics shown in FIG. 20A.

In FIG. 19A, a third sinusoidal waveform is shown representing a third harmonic 224. When the square wave signal 230 is out of phase or has no energy in phase with the third harmonic 224, its level is suppressed as shown in FIG. 19B. In FIG. 20A, the pulse width of the square wave signal 230 is changed to move energy into phase with the third harmonic 224, resulting in the level of the third harmonic 224 rising as shown in FIG. 20B.

Figure 21A:
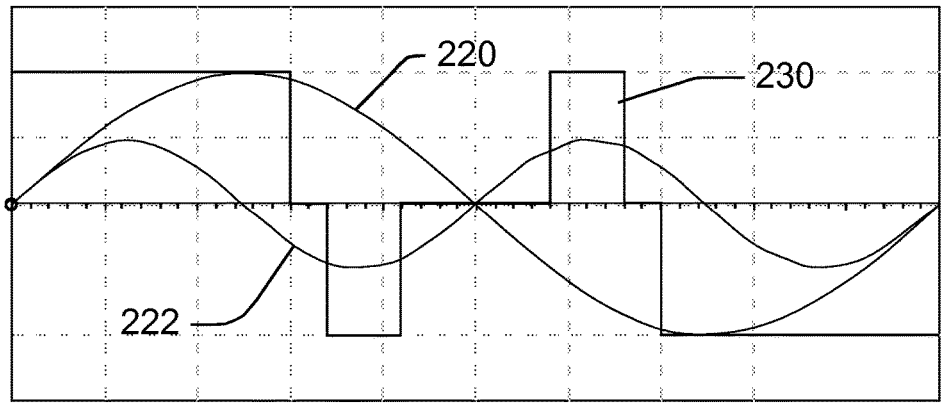
FIG. 21A is a chart showing sinusoidal waveforms representing a fundamental frequency and a harmonic, and a generated square wave.
Figure 21B:
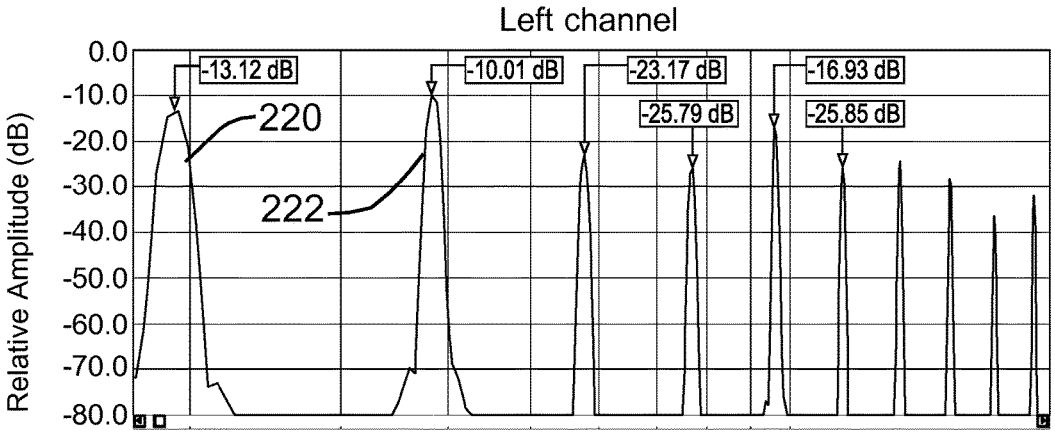
FIG. 21B is a chart illustrating resultant amplitude levels for the fundamental frequency and harmonics shown in FIG. 19A.

Thus, pulses of various widths and/or spaces are generated to replicate the fundamental tone and harmonics of the desired mechanical tone. Adjusting the spacing, width and polarity of the square wave pulses 230 provides a way to selectively emphasize or deemphasize the fundamental and various harmonics match the original sound. FIG. 21A illustrates an example where the square wave pulses 230 are generated such that energy has been removed from the fundamental 220 and added to the second harmonic 222.

Replicating the desired mechanical tone using square wave signals allows the use of a simple amplifier 204, which reduces the number of components required, improves efficiency, eliminates or reduces the need for heat sinks, and lowers overall cost. One example implementation operates at an efficiency between 97% and 98%. Because the amplitude of the square wave pulses 230 is fixed, the energy in each harmonic is relative to the width and phase of the pulse.

Since the square wave signal is very simple (composed of rectangular functions), the levels can be determined using a discrete Fourier transform.

Figure 22:
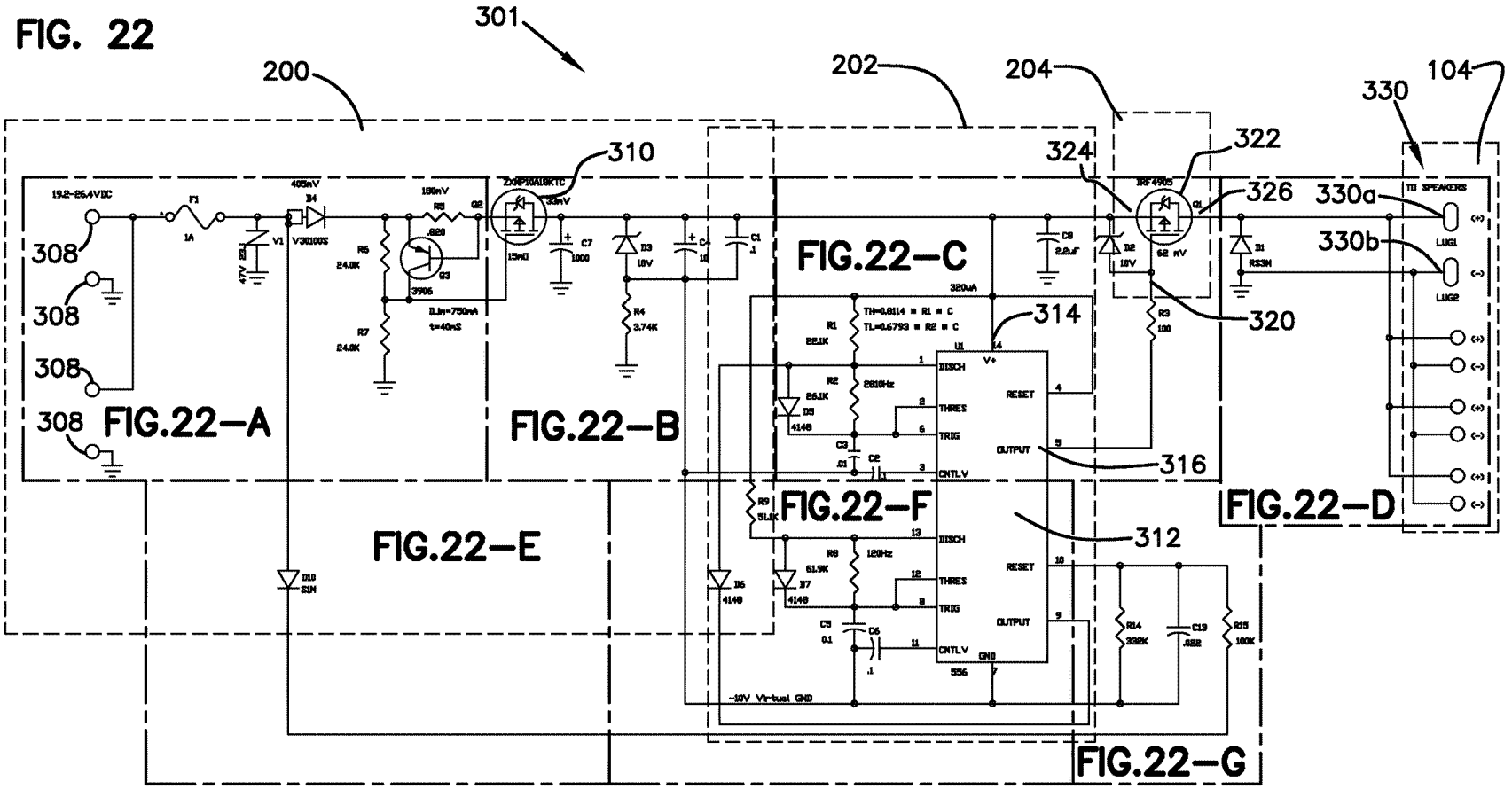
FIG. 22 is a schematic diagram illustrating an example tone production circuit in accordance with aspects of the present disclosure.

FIG. 22 is a schematic diagram illustrating aspects of an example of a disclosed tone generation system. FIGS. 22A-22G provide detailed views of the respective portions of the circuit 301 shown in FIG. 22. In one implementation, the circuit 301 shown in FIG. 22 is employed in the system 12 shown in FIGS. 3 and 4, though the circuit 301 and/or various aspects thereof could be used in other physical implementations. The circuit 301 operates on DC power, so the power input section 200 includes voltage input terminals 308 configured to receive a DC voltage input. Components such as a transistor 310 control the start-up voltage. The power input section 200 provides power for the tone generator 202 and amplifier 204.

The tone generator 202 includes a timer 312, which in the illustrated example is a LM556 dual timer available from Texas Instruments (www.ti.com). Using the timer 312 to generate the square wave signal simplifies the circuit, eliminating the need for a clock which, in turn, reduces heat generated so that heat sinks are not required. The timer 312 includes a voltage input 314 for receiving an input voltage from the power input section 200. The timer 312 is configured to generate square wave signals to replicate a fundamental frequency and harmonics of a desired mechanical tone. The timer 312 further includes an output terminal 316 connected to a signal input 320 of the amplifier 204.

As noted above, using square wave signals to replicate the desired mechanical tone allows for the use of a simple amplifier. In the example shown in FIG. 22, the amplifier 204 includes a single transistor 322. A voltage input terminal 324 of the amplifier 204 (source of transistor 322) receives an input voltage from the power input section 200, and an output terminal 326 of the amplifier (drain of transistor 322) is connected to terminals 330 of the speaker 102. The signal input 320 (gate of transistor 322) receives the square wave signal directly from the timer 312.

Since there is only the single transistor 322 in the amplifier 204, only one portion of the square wave signal provided to the speaker 102 from the timer 312 is amplified. The speaker 102 (and piezoelectric devices 114 in the illustrated embodiment) include "+" and "−" speaker terminals 330*a*, 330*b*. Only the + terminal 330*a* receives an amplified signal. A typical amplifier includes at least two devices to source voltage to a speaker in response to an input signal. Thus, the cone of the speaker is typically "pushed" and "pulled" in response to respective portions of the input signal. With the illustrated amplifier 204 including the single transistor 322, only one portion of the input square wave signal is amplified such that movement of the speaker 102 is amplified in one direction only. During the non-amplified portion of the input signal, the speaker is allowed to ring naturally, which creates additional harmonics.

Figure 23:
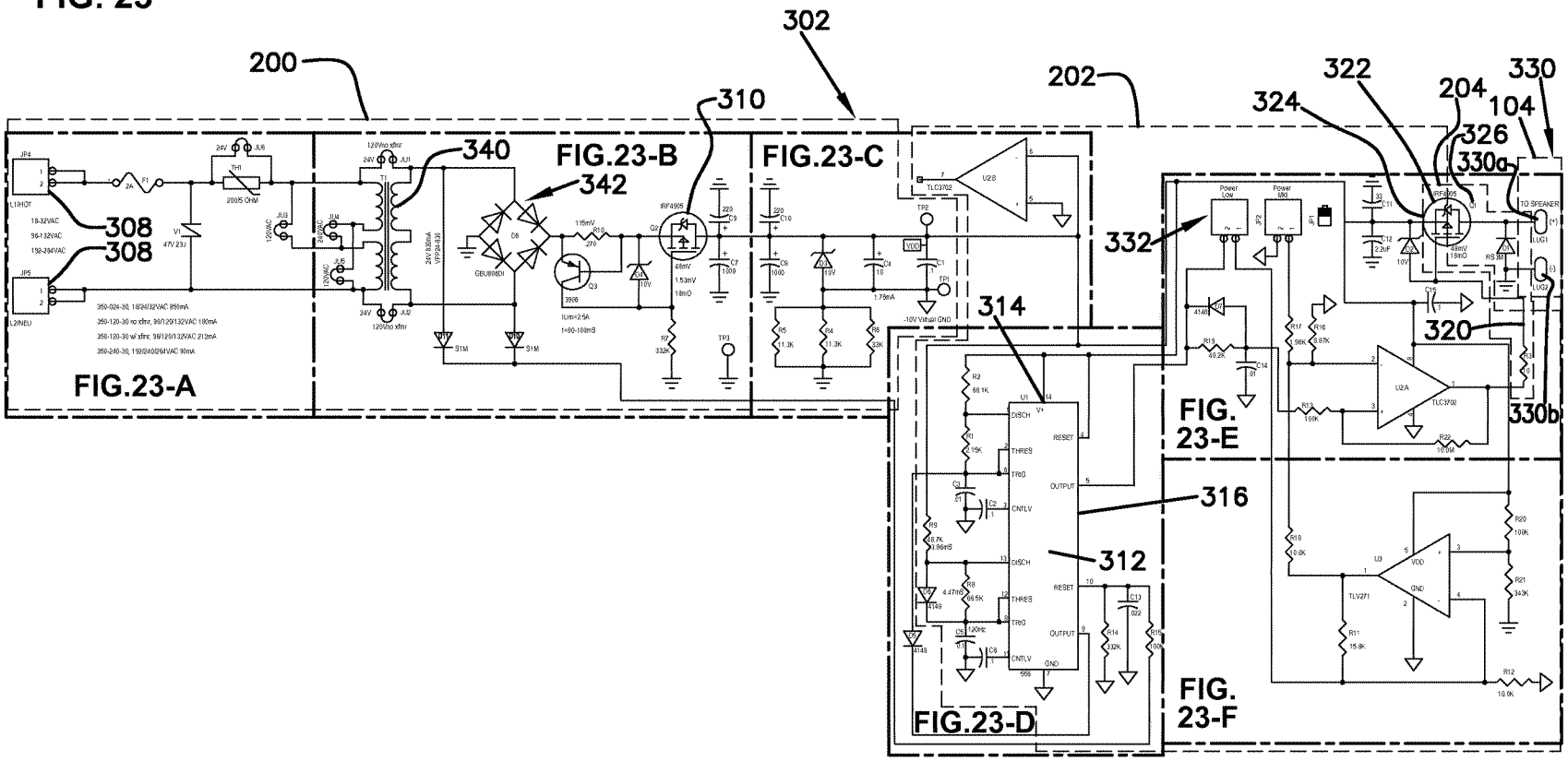
FIG. 23 is a schematic diagram illustrating another example tone production circuit in accordance with aspects of the present disclosure.

FIG. 23 is a schematic diagram illustrating aspects of another example of a disclosed tone generation system, with FIGS. 23A-23J providing detailed views of the respective portions of the circuit 302 shown in FIG. 23. The circuit 302 shown in FIG. 23 is configured to receive an AC input voltage, and thus voltage input terminals 308 connect to an AC power source. The power input section 200 includes a transformer 340 and full wave rectifier 342. As with the circuit 301 shown in FIG. 22, the power input section 200 includes a transistor 310 for suppressing an initial power surge upon start-up. The tone generator 202 in the circuit 302 also includes a timer 312, which in the illustrated example is a Texas Instruments LM556 dual timer. The timer 312 includes a voltage input 314 for receiving an input voltage from the power input section 200. The timer 312 is configured to generate square wave signals to replicate a fundamental frequency and harmonics of a desired mechanical tone. The output terminal 316 of the timer 312 is connected to the signal input 320 of the amplifier 204. As with the example shown in FIG. 22, the amplifier 204 shown in FIG. 23 includes a single transistor 322. The voltage input terminal 324 of the amplifier 204 (source of transistor 322) receives the input voltage from the power input section 200, and the output terminal 326 of the amplifier (drain of transistor 322) is connected to terminals 330 of the speaker 102. The signal input 320 (gate of transistor 322) receives the square wave signal directly from the timer 312.

The circuit 302 shown in FIG. 23 includes jumper connections 332 configured to vary the volume of the tone output from the speaker 102. In the illustrated example, the jumper connections 332 arranged to select between low and high power outputs. Selecting the desired jumper connection 332 varies the width of the square wave pulses to vary the volume of the tone. In one embodiment, the circuit 302 is used in the system 10 illustrated in FIGS. 1 and 2.

Figure 24:
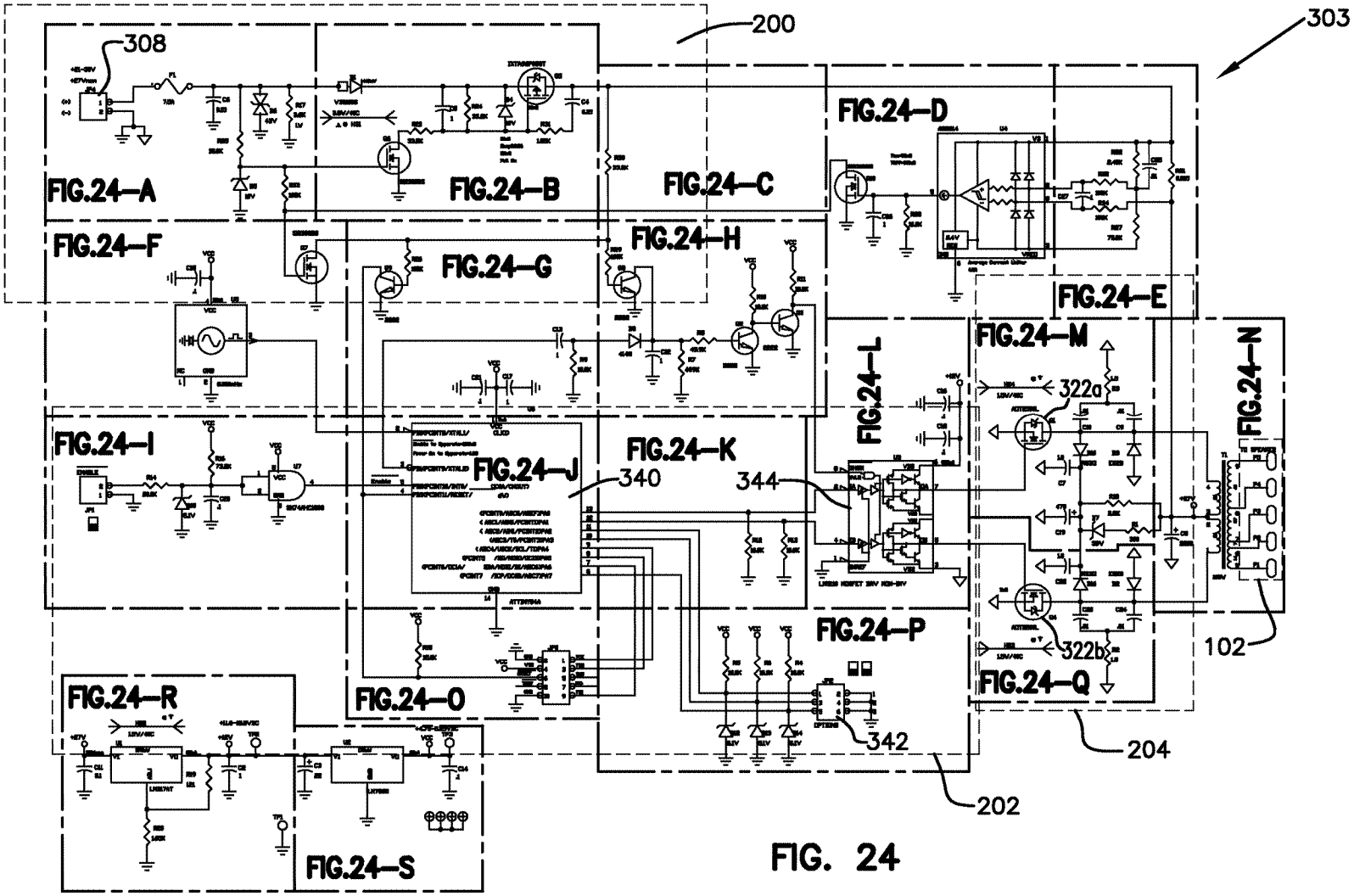
FIG. 24 is a schematic diagram illustrating another example tone production circuit in accordance with aspects of the present disclosure.

FIG. 24 illustrates aspects of another example of a disclosed tone generation system. FIGS. 24A-24S provide detailed views of the respective portions of the schematic diagram shown in FIG. 24. In one implementation, the circuit 303 shown in FIG. 24 is employed in the system 14 shown in FIGS. 7 and 8, though the circuit 301 and/or various aspects thereof could be used in other physical implementations. Similarly to the circuit 301 shown in FIG. 22, the circuit 302 operates on DC power so the power input section 200 includes voltage input terminals 308 configured to receive a DC voltage input. AC versions are also possible.

The circuit 303 shown in FIG. 24 is configured to selectively generate multiple sounds. The particular version shown generates four sounds. To make the different square wave signals to produce the respective sounds, the tone generator 202 includes a microcontroller 340, which in the illustrated example is an ATtiny84A microcontroller available from Atmel (www.atmel.com). Push on jumper connections 342 are provided for selection of the desire sound. Using the microcontroller 340 to generate the square wave signals allows for more variation in the types of sounds produced and the number of different sounds the device can generate.

Output signals from the microcontroller 340 are received by a driver 344 that boosts the output square wave signals to levels appropriate for the amplifier 204. In the illustrated circuit 303, the drive 344 is an LM5110 driver available from Texas Instruments. The boosted signals are then output to the amplifier 204. In the example shown in FIG. 24, the amplifier 204 includes first and second transistors 322*a*, 322*b* that receive respective outputs from the driver 344. The first and second transistors 322*a*,322*b* provide the amplified square wave signal to a transformer 346 that drives the speaker 102.

Figure 25A:
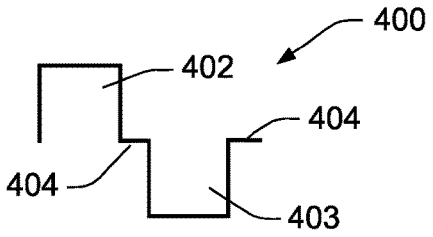
FIGS. 25A-25D illustrate examples of square wave signals for replicating sounds of mechanical devices.
Figure 25B:
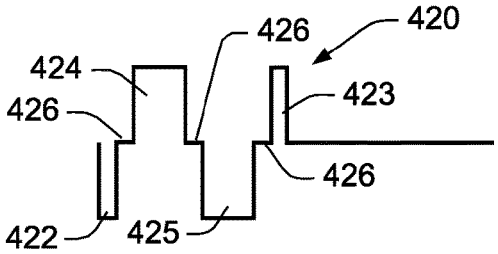

FIGS. 25A-25D illustrate examples of square wave signals generated for producing the four respective sounds output by the circuit 303. In FIG. 25A, the wave 400 has a period of 1,210 μs with a 74.05% duty cycle. Two pulses 402,403 are each 448 μs long, separated by an off period of 157 μs. The width and shape of the pulses 402, 403 of the wave 400 generate the first through the fifth harmonics of the sound being replicated. The space 404 between the pulses 402, 403 suppresses the second and fourth harmonics. With the wave 400 shown in FIG. 25A, the second harmonic is suppressed more than the wave form being replicated because the response of the speaker 102 boosts the level of the second harmonic. FIG. 25B illustrates a similar waveform 410 that has a period of 945 μs with a duty cycle of 60%. Two pulses 412,413 are each 333.6 μs long, separated by off periods 414 of 138 μs. The waveform 410 produces a siren sound that winds up to a higher pitch than the sound produced by the waveform 400 illustrated in FIG. 25A.

Figure 25C:
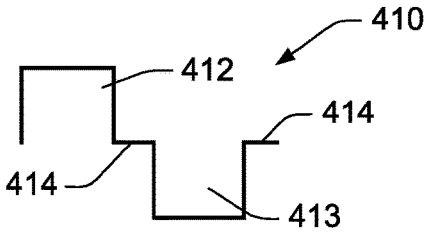
Figure 25D:
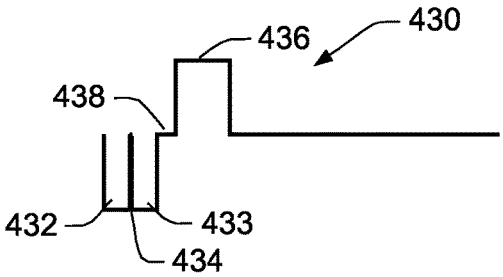

FIGS. 25C and 25D illustrate waveforms 420, 430 that replicate the sound produced by mechanical horns that have a vibrating metal diaphragm with a trumpet horn. The waveform 420 shown in FIG. 25C has a period of 3,168 μs with a 33% duty cycle. The waveform 420 includes two short pulses 422,423 that are each 132 μs, and two long pulses 424,425 that are each 396 μs long. Off periods 426 of 132 μs separate the pulses 422, 424, 425, 423. The waveform 430 illustrated in FIG. 25D has two short pulses 432, 433 that are each 110 μs separated by an off period 434 of 13 μs. A long pulse 436 is 233 μs long, separated from the short pulse 433 by an off period 438 of 80 μs.

Various modifications and alterations of this disclosure may become apparent to those skilled in the art without departing from the scope and spirit of this disclosure, and it should be understood that the scope of this disclosure is not to be unduly limited to the illustrative examples set forth herein.

What is claimed is:

1. A tone generation system, comprising:

a signal generator configured to generate a signal to reproduce a predetermined tone;

an amplifier configured to receive the signal;

a speaker connected to receive an output signal from the amplifier, the speaker having a speaker cone and a magnet adjacent a first side of the speaker cone, the speaker defining a speaker diameter;

a plurality of piezoelectric drivers adjacent a second side of the speaker cone opposite the first side, each of the piezoelectric drivers defining a driver diameter, wherein the piezoelectric drivers are arranged such that a first portion of each driver diameter is within the speaker diameter and a second portion of each driver extends beyond the speaker diameter.

2. The tone generation system of claim 1, wherein each of the piezoelectric drivers includes a cone attached to a piezoelectric bimorph, each cone defining a center axis, and wherein at least one of the center axes is situated within the speaker diameter.

3. The tone generation system of claim 1, wherein the signal generator includes a square wave signal generator configured to generate a first series of square wave signals to replicate a fundamental frequency of a desired mechanical tone, and a second series of square waves signals to replicate a second harmonic of the desired mechanical tone.

4. The tone generation system of claim 1, wherein the amplifier consists of a single transistor.

* * * * *